US010098510B2

(12) United States Patent
Buckalter et al.

(10) Patent No.: US 10,098,510 B2
(45) **Date of Patent: *Oct. 16, 2018**

(54) PNEUMATICALLY DRIVEN FLUID DISPENSER

(71) Applicant: Toaster Labs, Inc., Seattle, WA (US)

(72) Inventors: Amy Carol Buckalter, Seattle, WA (US); Jonathan B. Hadley, Renton, WA (US); Alexander M. Diener, Seattle, WA (US); Kristin M. Will, Seattle, WA (US); Gordon Cohen, Mercer Island, WA (US)

(73) Assignee: Toaster Loabs, Inc., Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/522,427

(22) Filed: Oct. 23, 2014

(65) Prior Publication Data

US 2015/0259128 A1 Sep. 17, 2015

Related U.S. Application Data

(63) Continuation-in-part of application No. 14/137,130, filed on Dec. 20, 2013, now Pat. No. 9,801,505.

(51) Int. Cl.
*B65D 83/16* (2006.01)
*A47K 5/12* (2006.01)
(Continued)

(52) U.S. Cl.
CPC ..... *A47K 5/1211* (2013.01); *A47K 5/122* (2013.01); *A47K 5/1217* (2013.01); *B05B 9/002* (2013.01); *B05B 9/0838* (2013.01); *B05B 12/122* (2013.01)

(58) Field of Classification Search
CPC .... A47K 5/1217; A47K 5/1211; A47K 5/122; B05B 9/002; B05B 9/0838; B05B 12/122
(Continued)

(56) References Cited

U.S. PATENT DOCUMENTS 1,537,552 A 2/1923 Rotunno
3,813,012 A * 5/1974 Laird ..... B05C 17/015 222/326
(Continued)

FOREIGN PATENT DOCUMENTS

DE 1654872 A1 4/1971
DE 10122337 A1 12/2002
(Continued)

OTHER PUBLICATIONS

International Search Report; dated Oct. 2, 2016; 4 Pages.
International Search Report; pp. 19; dated Nov. 22, 2016.
International Search Report; pp. 5; dated Nov. 22, 2016.

*Primary Examiner* — Nicholas J Weiss
(74) *Attorney, Agent, or Firm* — Lowe Graham Jones PLLC

(57) ABSTRACT

A dispenser includes a housing, an aperture within the housing, a receptacle within the housing, and a pneumatically driven actuator. The receptacle removably receives a reservoir, such that when the reservoir is received by the receptacle, an outlet port of the reservoir is exposed through the aperture. When the pneumatically driven actuator is actuated, the pneumatically driven actuator provides a dispensing force that induces a flow of a predetermined volume of fluid within the reservoir through the exposed outlet port of the reservoir and dispenses the predetermined volume through the aperture. In some embodiments, the dispenser includes an internal pneumatic source. The internal pneumatic source may include an air compressor. The dispenser may include a pneumatic input port that receives a pneumatic hose. The dispensing force translates a piston in the reservoir a predetermined distance. The predetermined distance may be linearly proportional to the predetermined volume of dispensed fluid.

16 Claims, 21 Drawing Sheets

(51) Int. Cl.

| | |
|---|---|
| ***A47K 5/122*** | (2006.01) |
| ***B05B 9/00*** | (2006.01) |
| ***B05B 9/08*** | (2006.01) |
| ***B05B 12/12*** | (2006.01) |

(58) Field of Classification Search
USPC ..... 222/52, 14, 325–327, 389, 399, 55, 183, 222/181.2, 181.3, 103, 63, 333
See application file for complete search history.

(56) References Cited

U.S. PATENT DOCUMENTS

| | | | | |
|---|---|---|---|---|
| 3,880,331 | A * | 4/1975 | Perkins | G01F 11/022 222/327 |
| 4,258,865 | A * | 3/1981 | Vahl | A47K 5/122 222/213 |
| 4,426,024 | A * | 1/1984 | Hogan | A61M 5/204 222/173 |
| 4,809,878 | A | 3/1989 | Rainey | |
| 4,875,604 | A | 10/1989 | Czech | |
| 4,967,937 | A | 11/1990 | von Schuckmann | |
| 5,015,233 | A * | 5/1991 | McGough | A61M 5/00 222/389 |
| 5,024,656 | A * | 6/1991 | Gasaway | A61M 5/30 604/141 |
| 5,096,092 | A * | 3/1992 | Devine | B67D 1/0462 222/105 |
| 5,100,025 | A * | 3/1992 | McGraw | A47K 5/1211 222/103 |
| 5,104,004 | A | 4/1992 | von Schuckmann | |
| 5,150,820 | A * | 9/1992 | McGill | A23G 3/28 222/146.6 |
| 5,240,144 | A * | 8/1993 | Feldman | B67D 1/0001 222/105 |
| 5,452,824 | A * | 9/1995 | Danek | B05C 11/1034 222/263 |
| 5,636,922 | A | 6/1997 | Clark | |
| 5,700,991 | A | 12/1997 | Osbern | |
| 5,788,124 | A | 8/1998 | Bougamont et al. | |
| 5,810,201 | A | 9/1998 | Besse et al. | |
| 5,836,482 | A | 11/1998 | Ophardt et al. | |
| 5,918,767 | A * | 7/1999 | McGill | A23G 3/28 222/105 |
| 6,013,270 | A | 1/2000 | Hargraves et al. | |
| 6,131,766 | A | 10/2000 | King et al. | |
| 6,209,751 | B1 | 4/2001 | Goodin et al. | |
| 6,209,752 | B1 | 4/2001 | Mitchell et al. | |
| 6,216,911 | B1 | 4/2001 | Kreitemier et al. | |
| 6,279,777 | B1 | 8/2001 | Goodin et al. | |
| 6,302,304 | B1 | 10/2001 | Spencer | |
| 6,311,868 | B1 | 11/2001 | Kreitemier et al. | |
| 6,454,127 | B1 | 9/2002 | Suomela et al. | |
| 6,467,651 | B1 | 10/2002 | Muderlak et al. | |
| 6,607,103 | B2 | 8/2003 | Gerenraich et al. | |
| 6,820,765 | B2 * | 11/2004 | Pahl | A23G 9/28 222/103 |
| 6,866,163 | B2 * | 3/2005 | McGill | A23G 9/28 222/103 |
| 6,978,912 | B2 * | 12/2005 | Taylor | B65D 83/72 222/146.3 |
| 7,033,004 | B2 * | 4/2006 | Ghisalberti | B41F 31/08 347/85 |
| 7,163,130 | B2 * | 1/2007 | Lafond | B05C 17/00503 222/326 |
| 7,337,920 | B2 * | 3/2008 | Duck | B67D 1/0878 222/129.4 |
| 7,527,178 | B2 | 5/2009 | Lewis | |
| 7,687,744 | B2 | 3/2010 | Walter et al. | |
| 8,056,764 | B2 | 11/2011 | Paasch et al. | |
| 8,061,918 | B2 | 11/2011 | Skalitzky et al. | |
| 8,087,543 | B2 | 1/2012 | Yang et al. | |
| 8,096,445 | B2 | 1/2012 | Yang et al. | |
| 8,104,982 | B2 | 1/2012 | Duru | |
| 8,109,411 | B2 | 2/2012 | Yang et al. | |
| 8,240,933 | B2 | 8/2012 | Skalitzky et al. | |
| 8,336,738 | B2 | 12/2012 | Bouix et al. | |
| 8,453,877 | B2 | 6/2013 | Ionidis | |
| 8,757,454 | B2 | 6/2014 | Dong et al. | |
| 8,783,511 | B2 | 7/2014 | Snodgrass | |
| 8,792,781 | B1 | 7/2014 | Randall et al. | |
| 8,882,378 | B2 | 11/2014 | Bylsma et al. | |
| 8,921,746 | B2 | 12/2014 | Baarman et al. | |
| 8,998,036 | B2 | 4/2015 | Zhou et al. | |
| 9,237,831 | B1 | 1/2016 | Luu et al. | |
| 9,271,613 | B2 | 3/2016 | Rosko et al. | |
| 2002/0108965 | A1 | 8/2002 | Hill et al. | |
| 2004/0129722 | A1 | 7/2004 | Pahl | |
| 2004/0226962 | A1 | 11/2004 | Mazursky et al. | |
| 2006/0054641 | A1 * | 3/2006 | Evers | B67D 1/0001 222/326 |
| 2006/0113326 | A1 | 6/2006 | Taylor et al. | |
| 2007/0000941 | A1 | 1/2007 | Hadden et al. | |
| 2008/0011784 | A1 * | 1/2008 | Schneider | B05C 17/00513 222/333 |
| 2008/0078780 | A1 | 4/2008 | Sanger et al. | |
| 2008/0142552 | A1 * | 6/2008 | Hemsen | B05C 11/1002 222/334 |
| 2009/0038685 | A1 | 2/2009 | Hill et al. | |
| 2009/0134139 | A1 | 5/2009 | Quartararo | |
| 2009/0140004 | A1 | 6/2009 | Scorgie | |
| 2011/0303695 | A1 | 12/2011 | Fern | |
| 2012/0085780 | A1 | 4/2012 | Landauer | |
| 2012/0085784 | A1 | 4/2012 | Bakris | |
| 2012/0111885 | A1 | 5/2012 | Binderbauer et al. | |
| 2012/0168459 | A1 | 7/2012 | D'Onofrio | |
| 2012/0305605 | A1 | 12/2012 | Vassaux et al. | |
| 2013/0020350 | A1 * | 1/2013 | Gardos | A01M 25/006 222/1 |
| 2013/0264328 | A1 | 10/2013 | Ulvr | |
| 2013/0264355 | A1 | 10/2013 | Jodoin | |
| 2014/0138402 | A1 | 5/2014 | Warren et al. | |
| 2014/0197198 | A1 | 7/2014 | Paetow et al. | |
| 2014/0219701 | A1 | 8/2014 | Eberlein | |
| 2014/0263440 | A1 | 9/2014 | Burns | |
| 2014/0353335 | A1 | 12/2014 | Van Diepen | |
| 2015/0078799 | A1 | 3/2015 | Baarman et al. | |
| 2015/0083754 | A1 | 3/2015 | Proper et al. | |
| 2015/0245421 | A1 | 8/2015 | Heczko | |
| 2015/0273513 | A1 | 10/2015 | Buckalter et al. | |

FOREIGN PATENT DOCUMENTS

| | | | |
|---|---|---|---|
| DE | 202012000728 | U1 | 4/2012 |
| EP | 0333093 | A1 | 9/1989 |
| EP | 0914055 | B1 | 1/2000 |
| EP | 1076810 | A1 | 2/2001 |
| EP | 1240480 | A1 | 9/2002 |
| EP | 1345840 | A2 | 9/2003 |
| EP | 1991095 | A2 | 11/2008 |
| EP | 2033555 | A1 | 3/2009 |
| EP | 2108106 | A1 | 10/2009 |
| EP | 2074906 | B1 | 4/2010 |
| EP | 2225988 | | 9/2010 |
| EP | 2274211 | A1 | 1/2011 |
| EP | 2364623 | A2 | 9/2011 |
| EP | 2579831 | A2 | 4/2013 |
| EP | 2865307 | A1 | 4/2015 |
| EP | 2637539 | B1 | 5/2015 |
| EP | 2640221 | A4 | 5/2015 |
| EP | 2451330 | B1 | 7/2015 |
| FR | 2873048 | A1 | 7/2004 |
| JP | 2001109943 | A | 4/2001 |
| WO | 0214211 | A1 | 2/2002 |
| WO | 2005002283 | A1 | 1/2005 |
| WO | 2007120791 | A2 | 10/2007 |
| WO | 2007120791 | A3 | 10/2007 |

* cited by examiner

PNEUMATICALLY DRIVEN FLUID DISPENSER

PRIORITY CLAIM

This patent application is a Continuation-in-Part of U.S. application Ser. No. 14/137,130, entitled AUTOMATIC FLUID DISPENSER, filed on Dec. 20, 2013, the contents of which are hereby incorporated by reference.

BACKGROUND OF THE INVENTION

Soap dispensers that are motion activated are well known. Such dispensers advantageously reduce the spread of germs and disease by not requiring any contact with the dispensers. Automated soap dispensers typically have large amounts of fluid that flows freely. The mechanisms of such dispensers retain a residual amount of soap, which is acceptable given the large reservoir size. Soap is left in the container. Soap also typically contacts the dispensing mechanism outside the container.

Motion activated dispensing could be advantageously used for other fluids such as personal lubricants or other substances dispensed in medical applications. In particular, the lack of contamination may be ideal. However, the dispensing of other fluids may not effectively be performed using existing soap dispensing mechanisms inasmuch as residual fluid left in the dispenser may be messy, non-hygienic, or result in unacceptable waste.

Furthermore, many soap dispensers use an electric motor to perform the mechanical work required to dispense the soap. The electric motor converts an electric potential supplied by a power source, such as a wall outlet or battery, into mechanical work. Most electric motors include a conductive path that includes numerous coils. In order to convert the electric potential to mechanical work, electric current must flow through the conductive coils. However, environmental conditions such as moisture, dirt, and vibration may affect the flow of current through the coils, and compromise the motor's performance.

Motors may fail completely if too much current is supplied to the coils. For instance, an electrical short between adjacent coils may reduce the resistance of the conductive path and significantly increase the current flowing through the coils. The increased current may provide significant heat and result in damaged the coils, causing a motor "burn out." Such motors often require complete replacement of at least the coils.

Additionally, many motors, such as stepper motors provide quantized amounts of mechanical work, resulting in discreet amounts of translational motion. Such motors cannot provide translational motion of a continuous nature or for an arbitrary amount of translation. Accordingly, it may be beneficial to use a more reliable source to provide the mechanical work required to operate a fluid dispenser. The systems and methods disclosed herein provide an improved dispensing mechanism that can be used for personal lubricants or other viscous fluids.

SUMMARY OF THE INVENTION

In one aspect of the invention, a dispenser includes a housing having a base configured to stably rest on a support surface. The housing includes a top portion positioned above the base such that a gap between the base and top portion is sized to receive a human hand. The top portion defines a cavity sized to receive a fluid reservoir and an opening extending directly through a lower surface of the top portion to the cavity. A pressing member is positioned within the cavity and an actuator is coupled to the pressing member and configured to urge the pressing member toward and away from the opening. A fluid reservoir may be positioned within the cavity; the fluid reservoir including a neck having a pressure actuated opening at a distal end thereof, the neck extending through the opening. In some embodiments, no portion of the dispenser, other than the base, is positioned in a flow path vertically beneath the pressure-actuated opening.

In another aspect, the dispenser includes a controller mounted within the housing and operably coupled to the actuator, the controller configured to selectively activate the actuator. The dispenser may include a proximity sensor mounted in the housing and configured to detect movement within the gap. Alternatively, the sensor may be a motion detector or other sensor. In the preferred embodiment, the proximity sensor is operably coupled to the controller and the controller configured to activate the actuator in response to an output of the proximity sensor. In some embodiments, the proximity sensor is mounted within the top portion and the controller is mounted within the base. The dispenser may further include a light emitting device mounted within a portion of the housing, preferably within the top portion. The top portion in such embodiment includes a downward facing translucent panel positioned below the light emitting device. The controller may be configured to activate the actuator to move between positions of a plurality of discrete positions including a start position and an end position in response to detecting of movement in the gap by the proximity sensor. The controller may also be configured to activate the actuator to move to the start position in response to detecting positioning of the actuator in the end position. The dispenser may additionally include a temperature-control element in thermal contact with the cavity or otherwise placed to heat the fluid reservoir. The temperature-control element is preferably a heating element, such as a resistance heater.

In another aspect, the actuator is configured to urge the pressing member in a first direction and the top portion includes a stop face arranged substantially transverse to the first direction (i.e., substantially normal to the first direction) and offset to a first side of the opening. The pressing member may include a pressing face extending upward from the opening and having a normal substantially parallel to the first direction. The pressing member may be positioned on a second side of the opening opposite the first side. The actuator is configured to urge the pressing member perpendicular to the first direction. In some embodiments, the top portion defines rails extending perpendicular to the first direction, the pressing member being configured to slidingly receive the rails. The fluid reservoir may be collapsible and positioned within the cavity having a first surface in contact with the stop face and a second surface in contact with the pressing face. The neck abuts the first surface. The body of the collapsible reservoir may have a substantially constant cross section along substantially an entire extent of the body between the first and second surfaces.

In another aspect, the pressing member includes a roller rotatably coupled to the actuator and defining an axis of rotation. The actuator is configured to move the roller in a first direction perpendicular to the axis of rotation across the cavity toward and away from the opening. The pressing member may include an axle extending through the roller, the top portion defining guides engaging end portions of the axle. The actuator may be coupled to the end portions of the axis by means of a flexible but substantially inextensible line. Springs may be coupled to the end portions of the axle and configured to urge the roller to a starting position offset from the opening.

In another aspect, the opening extends in a first direction through the lower surface of the top portion and the pressing member is positionable at a starting position having the cavity positioned between the opening and the pressing member. The actuator is configured to urge the pressing member from the starting position toward the opening along the first direction. In some embodiments, the lower surface of the top portion defines an aperture and a lid is hingedly secured to the lower surface and is selectively positionable over the aperture, the opening being defined in the lid. In some embodiments, one or more members extend from the cavity to a position offset from the cavity. Each member of the one or more members is pivotally mounted to the top portion and includes a first arm extending over the pressing member. The pressing member is positioned between the first arm and the opening. A second arm engages the actuator.

In another aspect, first and second rods are each pivotally coupled at a first end to one side of the cavity and having a second end positioned on an opposite side of the cavity. The actuator engages the first and second rods and draws the first and second rods through the cavity toward the opening.

In various embodiments, a dispenser includes a housing, an aperture within the housing, a receptacle within the housing, and a pneumatically driven actuator. The receptacle removably receives a reservoir, such that when the reservoir is received by the receptacle, an outlet port of the reservoir is exposed through the aperture. When the pneumatically driven actuator is actuated, the pneumatically driven actuator provides a dispensing force that induces a flow of a predetermined volume of fluid within the reservoir through the exposed outlet port of the reservoir and dispenses the predetermined volume through the aperture.

In some embodiments, the dispenser further includes an internal pneumatic source. The internal pneumatic source may include an air compressor. In at least one embodiments, the dispenser includes a pneumatic input port that receives a pneumatic hose. The dispensing force translates a piston in the reservoir a predetermined distance to induce the flow of and dispense the predetermined volume of fluid. The predetermined distance may be linearly proportional to the predetermined volume of dispensed fluid.

At least one embodiment includes another receptacle within the housing that is configured and arranged to removably receive a compressed air reservoir. The dispenser may include an internal electric power source. The dispenser includes a source that emits electromagnetic energy in a frequency band. The frequency band is within the visible spectrum. The emitted electromagnetic energy illuminates at least a portion of the dispenser.

In various embodiments, the actuator includes a driveshaft such that a compressed air source translates the driveshaft. The actuator may also include a spring-loaded mechanism to retract the driveshaft. The dispenser may include comprising a spring-loaded mechanism to eject the received reservoir. Various embodiments of dispenser include a pneumatic source indicator. The indicator indicates when at least one of a volume or a pressure of a pneumatic source is less than a predetermined threshold.

The housing includes a base portion underneath the aperture such that the housing is configured and arranged to receive a user's hand intermediate the base portion and aperture. The base portion may also include a containment depression positioned directly below the aperture and is configured and arranged to contain the dispensed volume of fluid. When the predetermined volume of fluid flows through the outlet port of the reservoir, the predetermined volume of fluid is dispensed without contacting a perimeter of the aperture. In some embodiments, the predetermined volume is based on a user selection. Some dispensers further include an inlet port to provide pressurized gas that is at a greater pressure than an ambient pressure, wherein the pressurized gas provides the dispensing force.

Some embodiments of a dispenser include a housing, a pressing member, and an actuator. The housing includes a base and a top portion. The base is configured to rest on a support surface. The top portion is positioned above the base such that a gap between the base and top portion is sized to receive a human hand, the top portion defining a cavity sized to receive a fluid reservoir and an opening extending directly through a lower surface of the top portion to the cavity. The pressing member is positioned within the cavity. The actuator is coupled to the pressing member and configured to translate when exposed to a pneumatic source and urge the pressing member at least one of toward and away from the opening.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
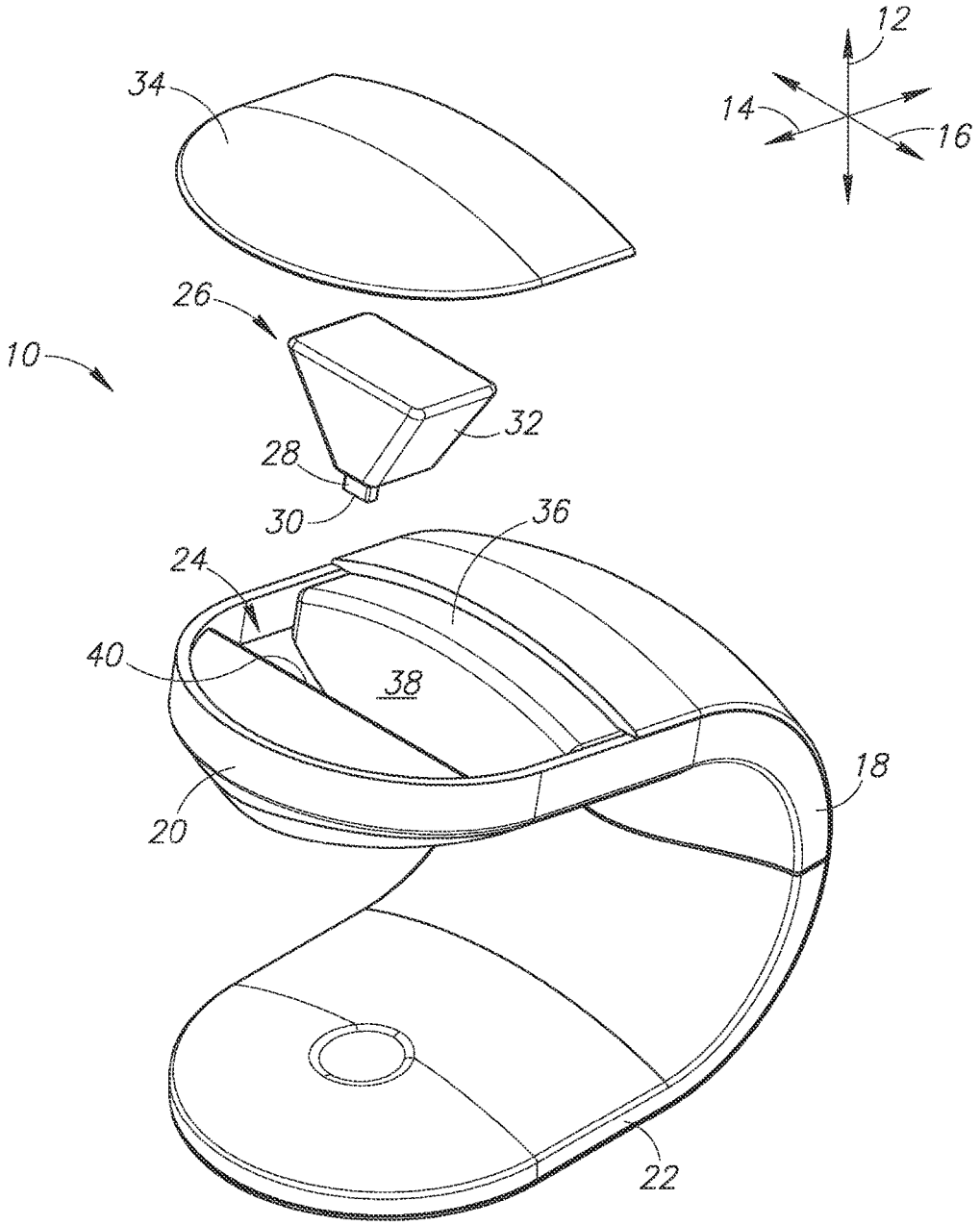
FIG. 1 is an isometric view of a first embodiment of a dispenser incorporating a compressing element in accordance with an embodiment of the invention.

Referring to FIG. 1, a dispenser 10 may be understood with respect to a vertical direction 12, a longitudinal direction 14 perpendicular to the vertical direction 12, and a lateral direction 16 perpendicular to the vertical and longitudinal directions 12, 14. The vertical direction 12 may be perpendicular to a planar surface on which the dispenser 10 rests. Likewise, the lateral and longitudinal directions 14, 16 may be parallel to the support surface.

The dispenser 10 may include a housing 18 that has a C-shape in the longitudinal-vertical plane. Accordingly, the housing 18 may include an upper portion 20 and a base 22 such that a vertical gap is defined between the upper portion 20 and the base 22. The upper portion 20 may define a cavity 24 for receiving a reservoir 26. The reservoir 26 may include a neck 28 defining an opening 30 and a body 32 coupled to the neck 28. The neck 28 may be smaller such that the body 32 can be inserted into an opening through which the body 32 cannot pass, or cannot pass through without deformation. The cavity 24 may be wider than the body 32 in the lateral direction 16 to facilitate removal of the reservoir 26. The opening 30 may be a pressure sensitive opening that is closed in the absence of pressure applied to the body 32, but will permit fluid to pass there through in response to an above-threshold pressure at the opening 30. For example, the opening 30 may be any of various "no-drip" systems used in many condiment dispensers known in the art.

The cavity 24 may be accessible by means of a lid 34 covering a portion of the upper portion 20. The lid 34 may secure to the upper portion 20 vertically above the upper portion 20, vertically below the upper portion 20 or to a lateral surface of the upper portion 20. The lid 34 may be completely removable and secure by means of a snap fit or some other means. The lid 34 may also be hingedly secured to the upper portion or slide laterally in and out of a closed position. For example, a slide out drawer defining a portion of the cavity 24 for receiving the reservoir 26 may slide in and out of a lateral surface of the upper portion 20.

A pressing member 36 is slidable into and out of the cavity 24 in order to compress the reservoir 26 and retract to enable insertion of a refill reservoir 26 after an extractable amount of fluid has been pressed out of an original reservoir 26. The pressing member 36 may define a pressing face 38 positioned opposite a stop face 40 defining a wall of the cavity 24.

Figure 2:
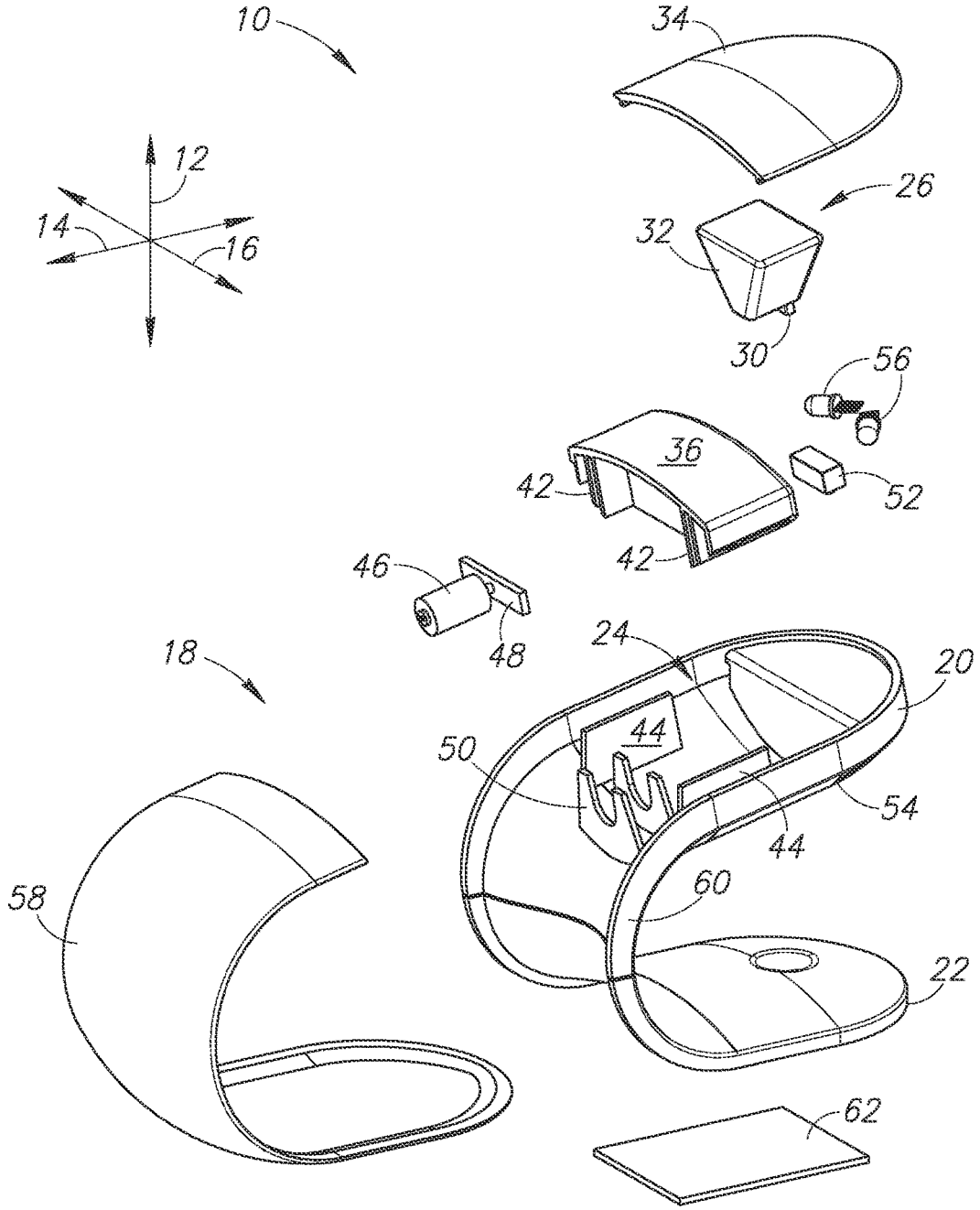
FIG. 2 is an exploded view of the dispenser of FIG. 1.

Referring to FIG. 2, the pressing member 36 may slidably mount to the housing 18. For example, the pressing member 36 may define one or more slots 42 that receive rails 44 secured to the upper portion 20. Alternatively, rails formed on the pressing member 36 may insert within slots defined by the upper portion 20. An actuator 46 may engage the pressing member 36 in order to move the pressing member 36 toward the reservoir 26 in order to force fluid therefrom. The actuator 46 may be any linear actuator, such as a motor driven screw or worm gear, servo, rotating cam, or the like. In particular, the actuator 46 may advantageously maintain its state in the absence of applied power. The actuator 46 may secure within one or more actuator mounts 50 secured to the upper portion 20 or some other portion of the housing 18, including the base 22. In the illustrated embodiment, the actuator 46 engages the pressing member 36 by means of a spreader 48 that distributes the force over a greater area of the pressing member 36.

The dispenser 10 may include a proximity sensor 52 that is configured to sense the presence of a human hand within the gap between the upper and lower portions 20, 22. The mode in which the proximity sensor 52 identifies the presence of a human hand may include various means such as by detecting reflected light, interruption of light incident on the proximity sensor 52, detecting a thermal signature or temperature change, change in inductance or capacitance, or any other modality for detecting movement, proximity, or presence of hand. The proximity sensor 52 may protrude below a lower surface 54 of the upper portion 20 or be exposed through the lower surface 54 to light, air, or thermal energy in the gap between the upper and lower portions 20, 22. Other sensors than proximity sensors may be employed, such as voice-activated sensors. Furthermore, multiple sensors may be employed in the same or various parts of the device.

In some embodiments, one or more light-emitting elements 56 may be mounted in the upper portion 20 and emit light into the gap between the upper and lower portions 20, 22. For example, the lower surface 54 or a portion thereof may be translucent or perforated to allow the light from the light-emitting elements to reach the gap. The light-emitting elements 56 may be light emitting diodes (LED), incandescent bulbs, or other light emitting structure. Alternatively, lighting elements may provide light emitting from the bottom or side.

Various structures or shapes may form the housing 18. In the illustrated embodiment, the housing 18 includes a curved outer portion 58 and a curved inner portion 60 that when engaged define a curved or C-shaped cavity for receiving the components of the dispenser 10. The ends of the curved portions 58, 60 may be planar, or include planar surfaces. In particular, the outer curved portion 58 may include a lower end with a planar lower surface for resting on a flat surface, or three or more points that lie in a common plane for resting on a flat surface.

A controller 62 may mount within the housing 18, such as within the base 22. The controller 62 may be operably coupled to some or all of the actuator 46, proximity sensor 52, and light-emitting elements 56. The controller 62 may be coupled to these elements by means of wires. The controller 62 may also be coupled to a power source (not shown) such as a battery or power adapter. The controller 62 may be embodied as a printed circuit board having electronic components mounted thereon that are effective to perform the functions attributed to the controller 62. The controller 62 may include a processor, memory, or other computing capabilities to perform the functions attributed thereto.

Figure 3:
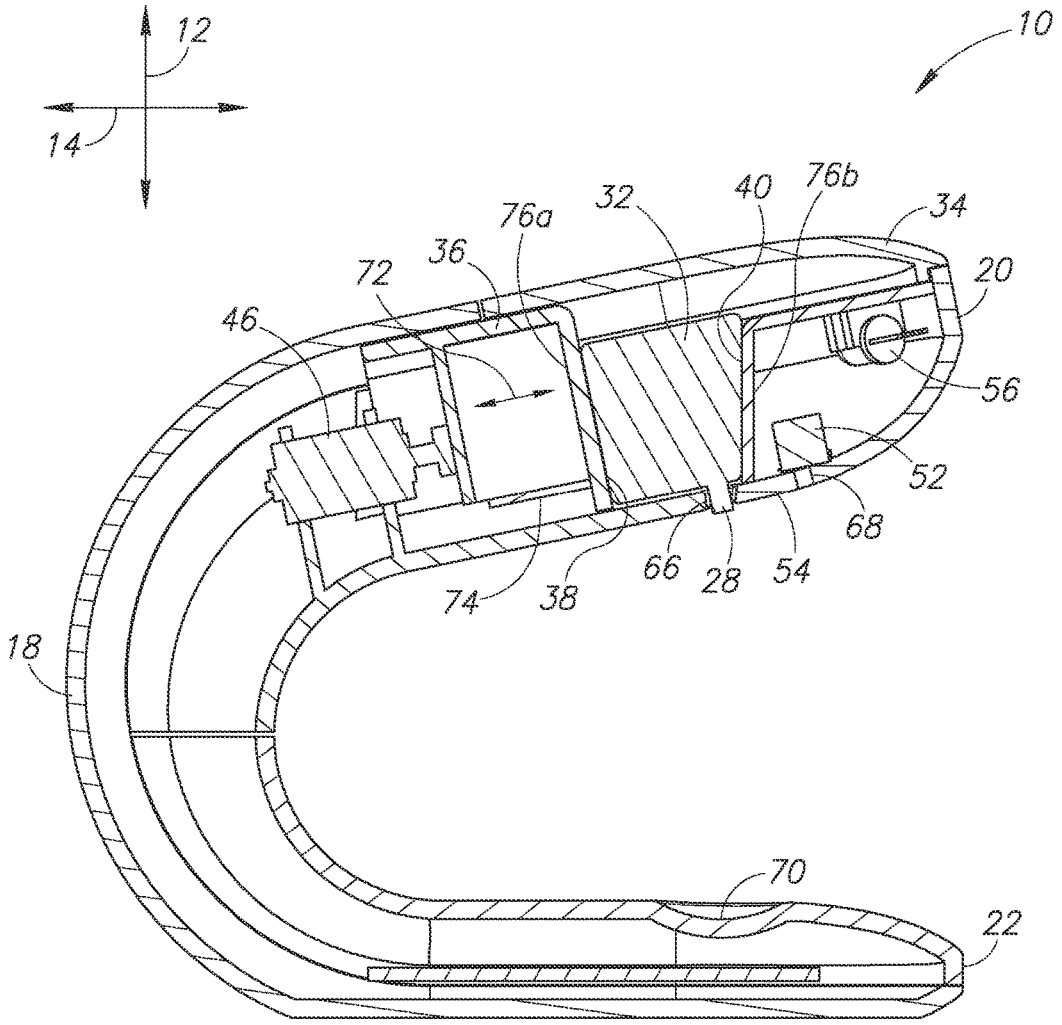
FIG. 3 is a side cross-sectional view of the dispenser of FIG. 1.
Figure 4:
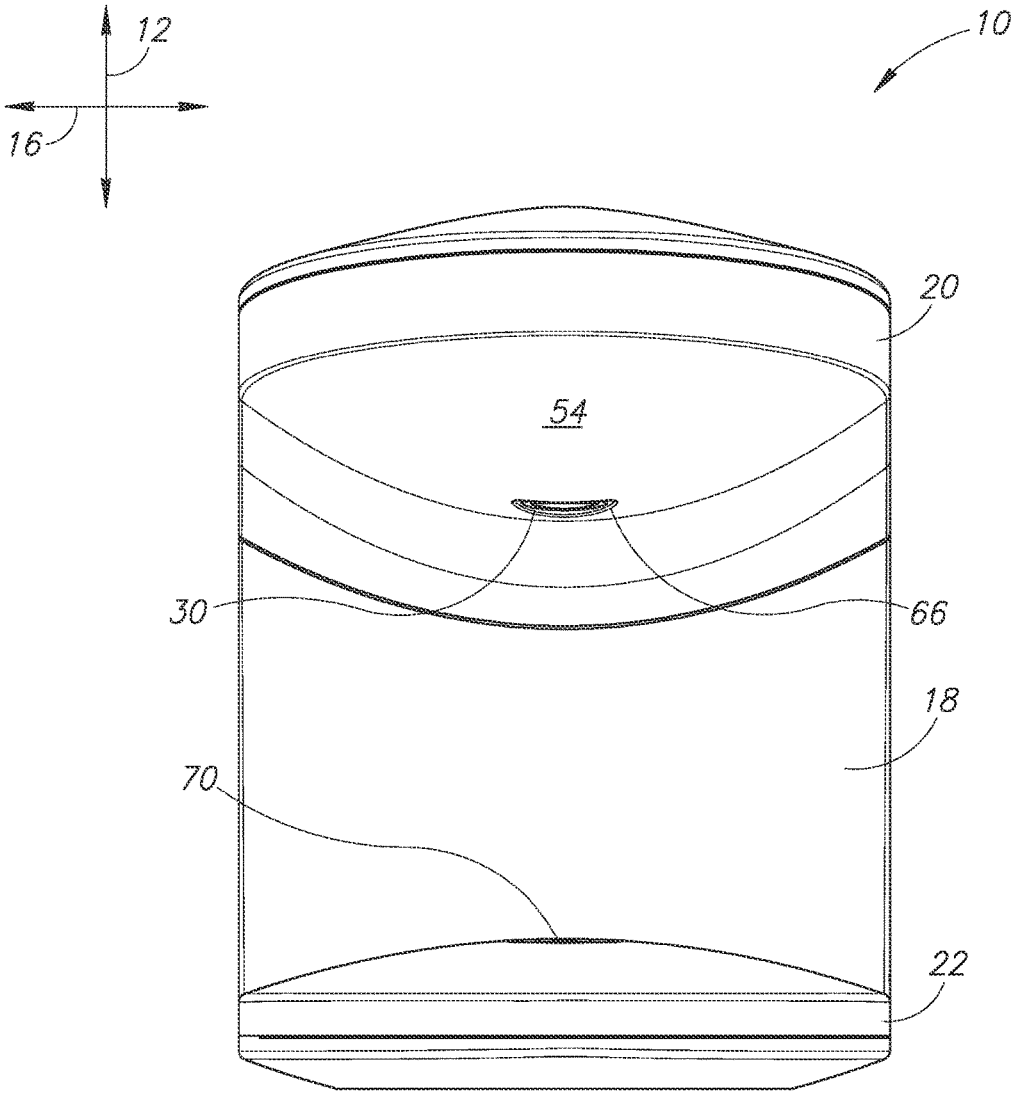
FIG. 4 is a front elevation view of the dispenser of FIG. 1.

Referring to FIGS. 3 and 4, the lower surface 54 of the upper portion 20 may define an opening 66 for receiving the neck 28 of the reservoir 26. As shown, the opening 30 is free to dispense fluid without the fluid being incident on any portion of the dispenser, other than the base 22, if the fluid is not incident on a user's hand. As is also apparent, the opening 30 and the neck 28 are disposed closer to the stop face 40 than to the pressing face 38. In this manner, as the body 32 of the reservoir 26 is collapsed, the neck 38 inserted within the opening 30 does not interfere with advancing of the pressing face 38. The neck 28 may be located as close as possible to the surface of the body 32 engaging the stop face 40. For example, a gap between the stop face 40 and the pressing face 38 above the opening 66 (e.g. measured parallel to the surface of the housing supporting the reservoir 26) may be X and the distance between the stop face 40 and the neck 28 and the side of the neck closest the stop face may be less than 10% X, preferably less than 5% X.

The lower surface 54 of the upper portion 20 may additionally define an opening 68 for receiving a portion of the proximity sensor 52 or for allowing light, vibrations, thermal energy, and the like to be incident on the proximity sensor 52. The lower surface 54 may additionally include an opening for allowing light from the light-emitting devices 56 to radiate the gap. Alternatively, the lower surface 54 may be translucent or transparent or include translucent or transparent portions to allow light to pass through the lower surface 54. In some embodiments, a marker 70, such as a depression, painted mark, or other visual indicator may be defined in an upper surface of the base 22 positioned vertically below the opening 66 to indicate where the dispenser 10 will dispense fluid.

The pressing member 36 may slide back and forth in an actuator direction 72 that is generally parallel to the longitudinal direction, e.g. within 20 degrees. The pressing face 38 may be substantially perpendicular to the actuator direction 72, e.g. the normal of the pressing face 38 may be within +/−5, preferably within +/−1, degree of parallel to the actuator direction 72. The stop face 40 may also be substantially perpendicular to the actuator direction (i.e. have a nearly parallel normal). However, in the illustrated embodiment, the stop face 40 is slanted to facilitate insertion of the reservoir 26. For example, the stop face may have a normal that points upward from the actuator direction 72 by between 2 and 10 degrees, or some other non-zero angle.

In some embodiments, the reservoir 26 may be directly or indirectly heated by a heating element 74 that may be operably coupled to the controller 62 or directly to a power source and may include a thermal sensor enabling thermostatic control thereof. In the illustrated embodiment, the heating element 74 is coupled to the pressing member 36, such as to the illustrated lower surface of the pressing member perpendicular to the pressing face 38. Other possible locations include the illustrated location 76*a* immediately opposite the pressing face 38 or location 76*b* immediately opposite the stop face 40. In some embodiments, it may be sufficient to simply heat the air around the reservoir 26 such that thermal contact with the reservoir 26 or structure facing the reservoir 26 is not required. Accordingly, the heating element 74 may be placed at any convenient location within the upper portion 20 or some other part of the housing 18. Other temperature-control elements may alternatively be used to either heat or cool or maintain a temperature of the fluid.

The controller 62 may be configured to move the pressing member 36 from a starting position shown in FIG. 3 to an end position located closer to the stop face 40. The controller 62 may be configured to move the pressing member 36 between discrete positions between the start and end positions. For example, the controller 62 may be configured to cause the actuator 46 to move the pressing member 36 from one position to a next position responsive to a detecting of movement based on an output of the proximity sensor 52. Upon detecting the pressing member 36 reaching the end position, the controller 62 may be configured to cause the actuator 46 to move the pressing member 36 to the start position. Detecting reaching of the end position may be determined by counting a number of times the pressing member 36 has been advanced from the start position, e.g. upon advancing the pressing member N times, the controller 46 may be configured to return the pressing member to the start position. In one preferred embodiment, the user may adjust the amount of advancement of the pressing member 36 with the controller. In this way an individual user may have more or less fluid delivered to the hand upon placing the hand beneath the opening. A rotatable adjustment knob or other switch (e.g., up & down arrow buttons) may be provided for such purpose.

Figure 5:
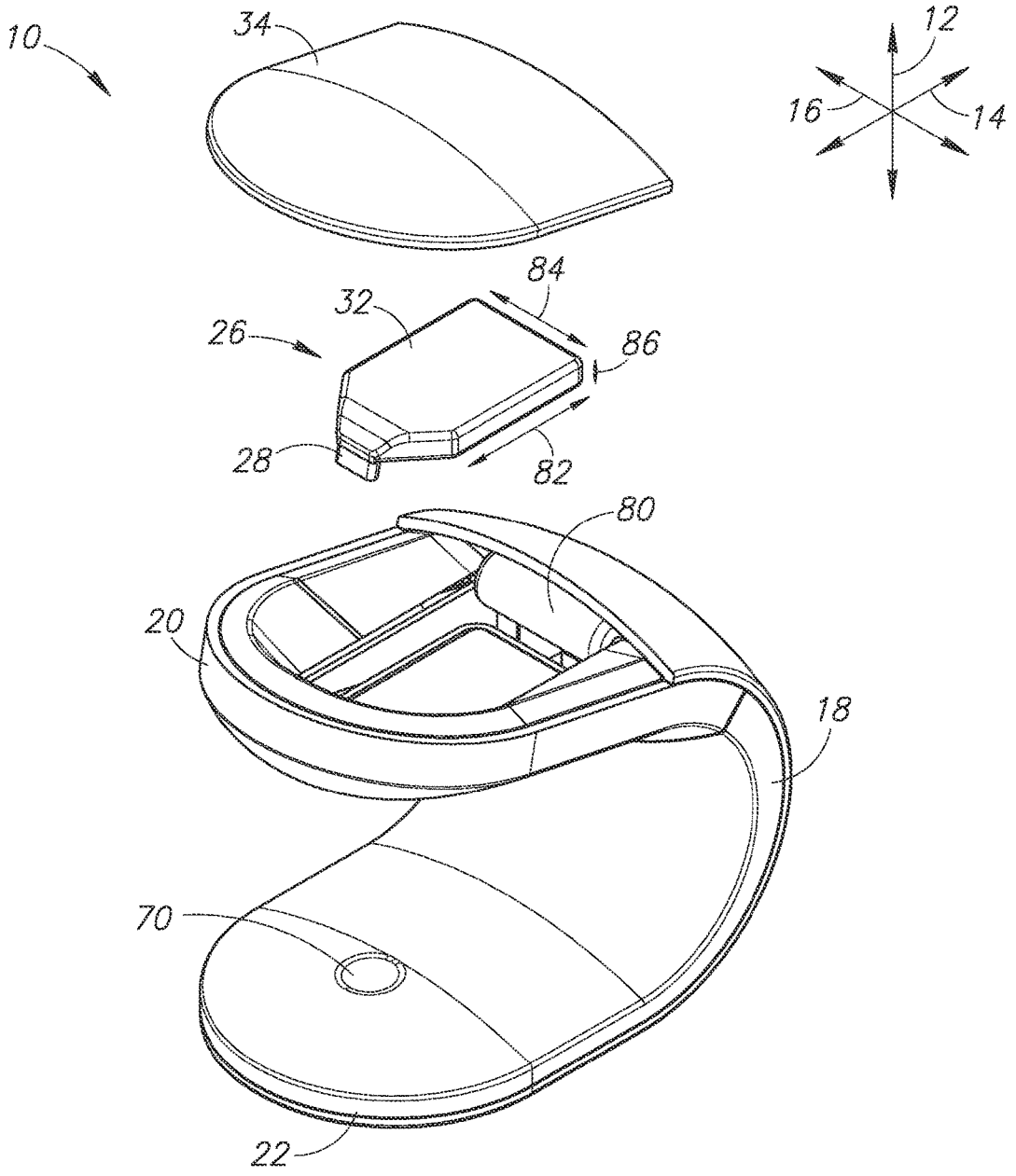
FIG. 5 is an isometric view of a second embodiment of a dispenser incorporating a rolling element in accordance with an embodiment of the invention.

Referring to FIG. 5, in some embodiments, the pressing member 36 may be embodied as a roller 80 that squeezes fluid from the reservoir 26 as it is urged across the reservoir. To facilitate this operation, the body 32 may be flat such that the length 82 and width 84 thereof are substantially greater than a thickness 86 thereof. The width 84 dimension may be parallel to an axis of rotation of the roller 80 when placed within the cavity 24 and the length 82 may be parallel to a direction of travel of the roller 80 in response to actuation thereof. The thickness 86 dimension may be perpendicular to both the length and width 82, 84 dimensions. The neck 28 may be located at or near an end of the body 32 along the length dimension 82 thereof. In particular, to enable insertion of the reservoir 26, the roller 80 may be positioned at a starting position shown in FIG. 5. The neck 28 may be located at an end of the body 32 opposite the end closest the roller 80 when in the illustrated starting position.

Figure 6:
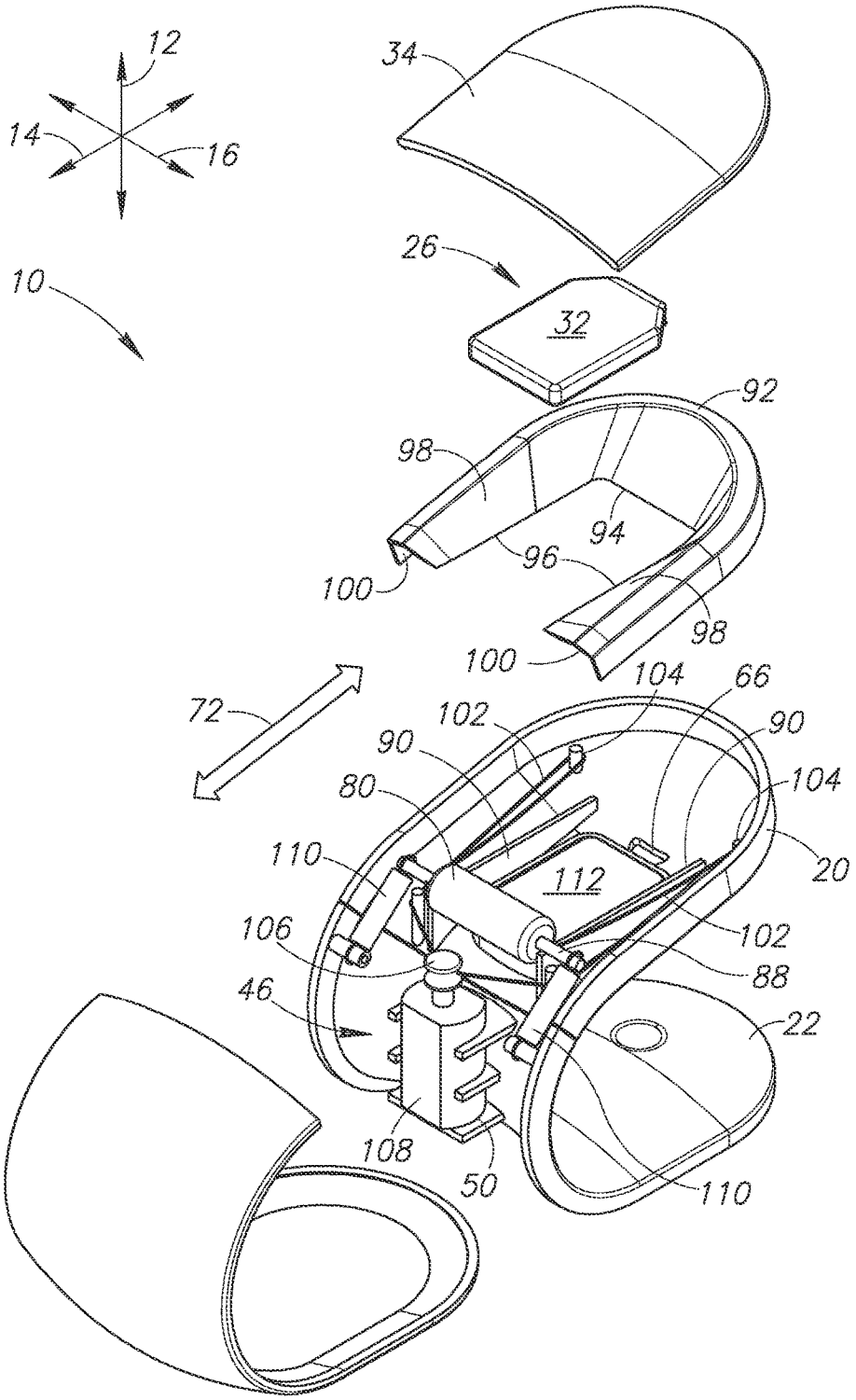
FIG. 6 is a partially exploded view of the dispenser of FIG. 5.
Figure 7:
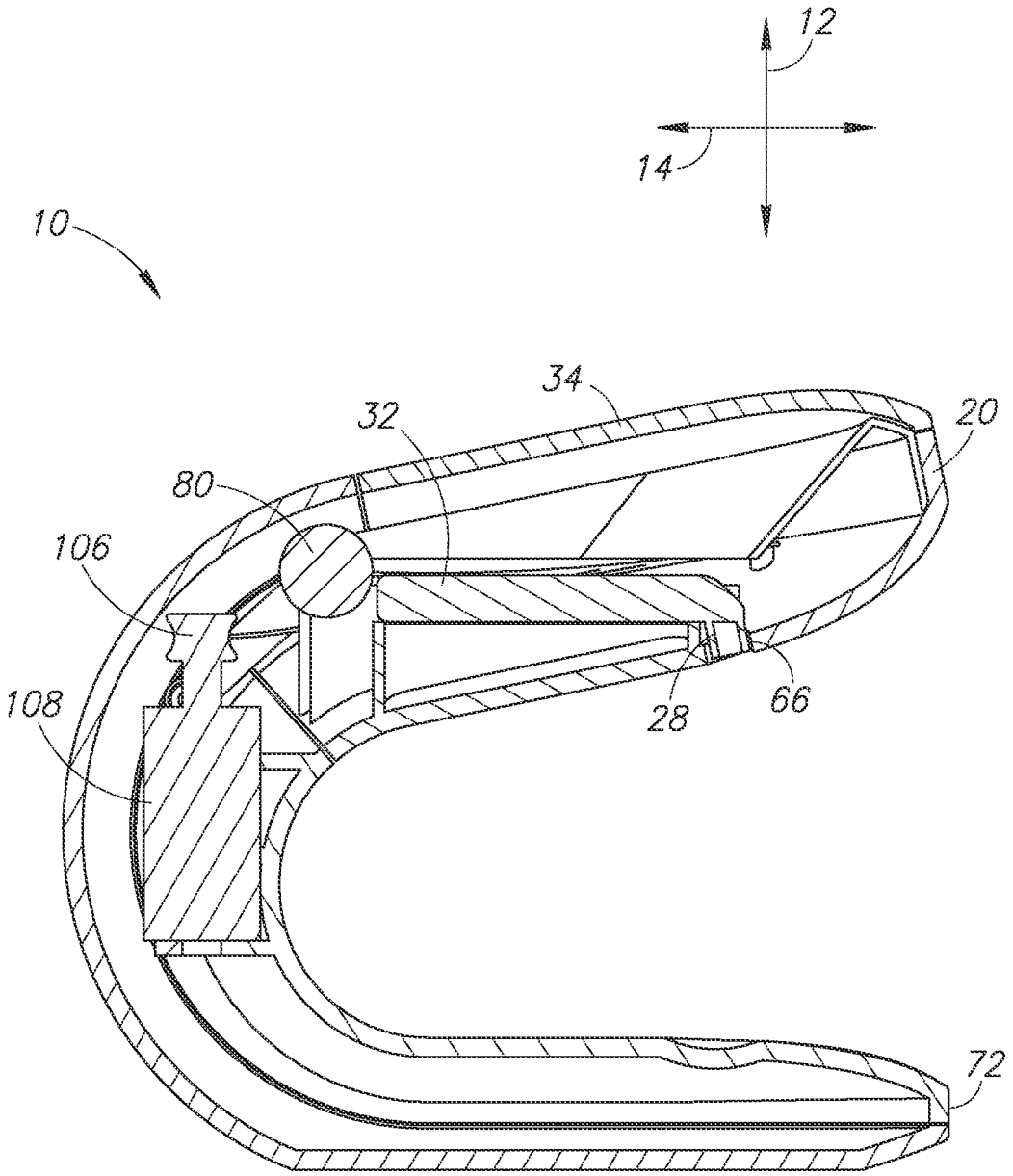
FIG. 7 is a side cross-sectional view of the dispenser of FIG. 5.

Referring to FIGS. 6 and 7, the roller 80 may rotate about one or more axles 88 having ends that protrude out of the roller 80. The axles may rest on ridges 90 that define the actuation direction 72 for the roller 80 and have upper edges parallel to the actuation direction 72. The axles 88 may further be retained on the ridges 90 by means of a U-shaped cover 92. The cover 92 may include a cutout portion 94 having parallel edges 96 between which the roller 80 is permitted to travel. The edges 96 or other portion of the cover 92 may be positioned opposite the ridges 90 in order to provide a slot within which the axles 88 may slide. The cover 92 may have faces 98 that slope upward with distance from the cutout 94 in order to guide the reservoir 26 into the cavity 24. The cover 92 may define channels 100 on either side, or a U-shaped channel extending on both sides, of the cut out portion 94.

In some embodiments, the channels 100 may provide a space for accommodating lines 102 for pulling the axle along the slot between the edges 96 and the ridges 90. In the illustrated embodiment, the lines 102 secure to ends of the axle 88, extend around posts 104, and each couple to a common pulley 106 or spool that is driven by an actuator 46 including a rotational actuator 108. In response to rotation of the rotational actuator 108, the lines are wound onto the pulley 106 thereby drawing the roller 80 toward the posts 104 and the opening 66 through which the neck 28 of the reservoir 26 passes. To return the roller 80 to the starting position, biasing members, such as springs 110 may be coupled to the housing 18 and to the axle 88 on either side of the roller 80. Upon removal of force exerted by the rotational actuator 108, the springs 110 may urge the roller back to the starting position. Alternatively, the springs may bias the roller toward a forward position of compression of the reservoir. In such an alternate embodiment, the lines 102 and actuator 108 serve to allow the roller to advance under the pull of the spring or springs and to pull the roller back against the spring pressure to a non-compressing, starting position.

The rotational actuator may maintain its state, e.g. lock when not changing position, such that the roller 80 may be stepped between various positions between the starting position and a final position nearest the opening 66. As is apparent in FIG. 6, a support surface 112 may support the body 32 of the reservoir 26 such that the body 32 is pinched between the roller 80 and the support surface 112 during movement of the roller.

The embodiment of FIGS. 5 to 7 may likewise include a controller 62, proximity sensor 52, and lights 56 configured similar to those shown in FIGS. 1 to 4. As for other embodiments disclosed herein, the controller 62 may be configured to advance the roller 80 between discrete positions in response to detecting proximity using the proximity sensor 52. Likewise, the controller 62 may be configured to return, or allow the return, of the roller 80 to the start position upon reaching the end position. The embodiments of FIGS. 5 to 7 may likewise include a heating element 74 as for the embodiments of FIGS. 1 to 4 located at a location within the upper portion 20, such as interfacing with the support surface 112 or otherwise positioned to heat air within the upper portion 20.

Figure 8:
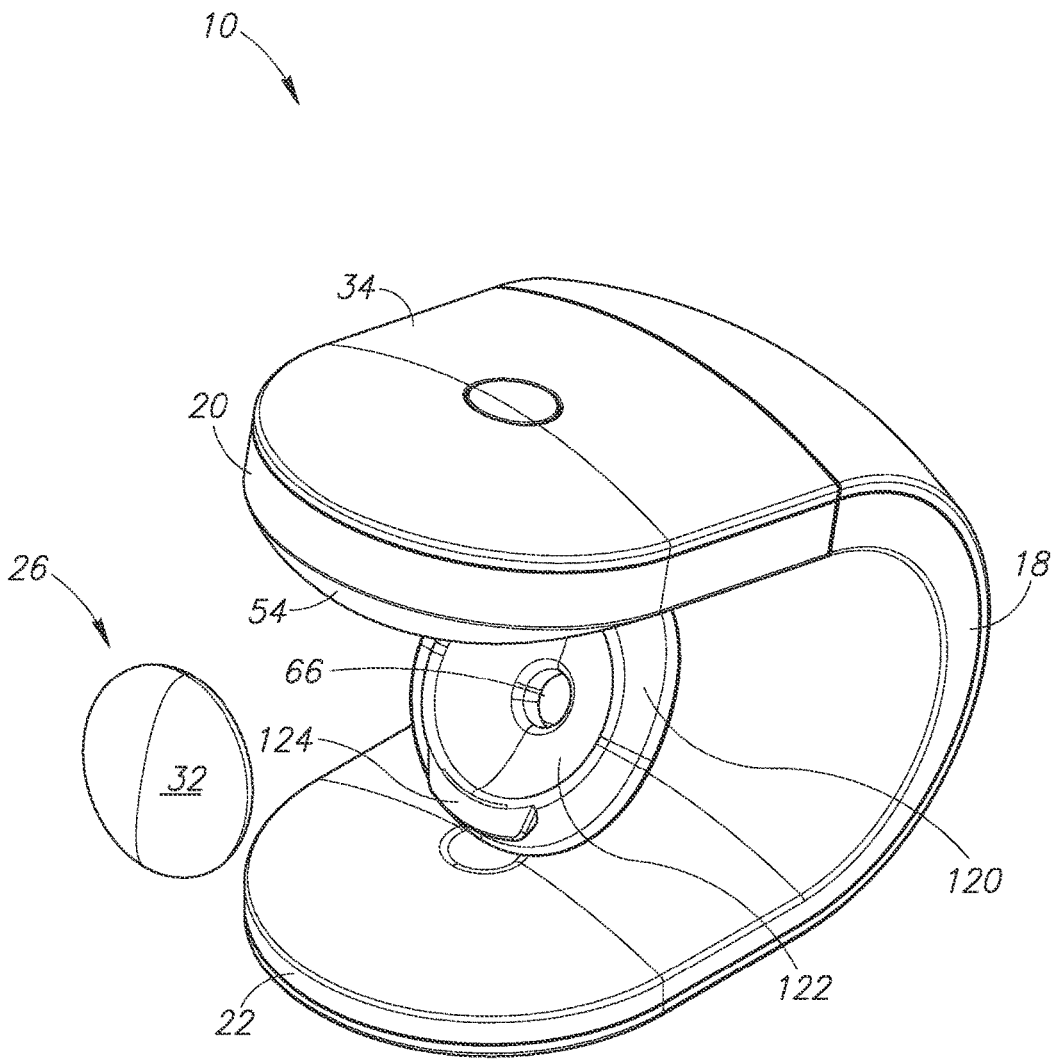
FIG. 8 is an isometric view of a third embodiment of a dispenser incorporating a plunger in accordance with an embodiment of the invention.

Referring to FIG. 8, in some embodiments, a reservoir cover 120 may secure to the lower surface 54 by a hinge or be completely removable and secure by a snap fit or some other means. The opening 66 for receiving the neck 28 of the reservoir 26 may be defined in the reservoir cover 120. Accordingly, in use, the neck 28 (see FIGS. 9-11) may be placed in the opening 66 having the body 32 of the reservoir 26 seated within a seat 122, such as a concave or other surface, and the reservoir cover 120 may then be secured to the lower surface 54.

In the illustrated embodiment, a distal end, e.g. opposite any hingedly secured end, of the cover 120 may include a ridge 124 or lip 124 for engaging a detent mechanism. However, any retention mechanism or detent mechanism may be used to retain the cover 120 in a selectively releasable manner.

Figure 9:
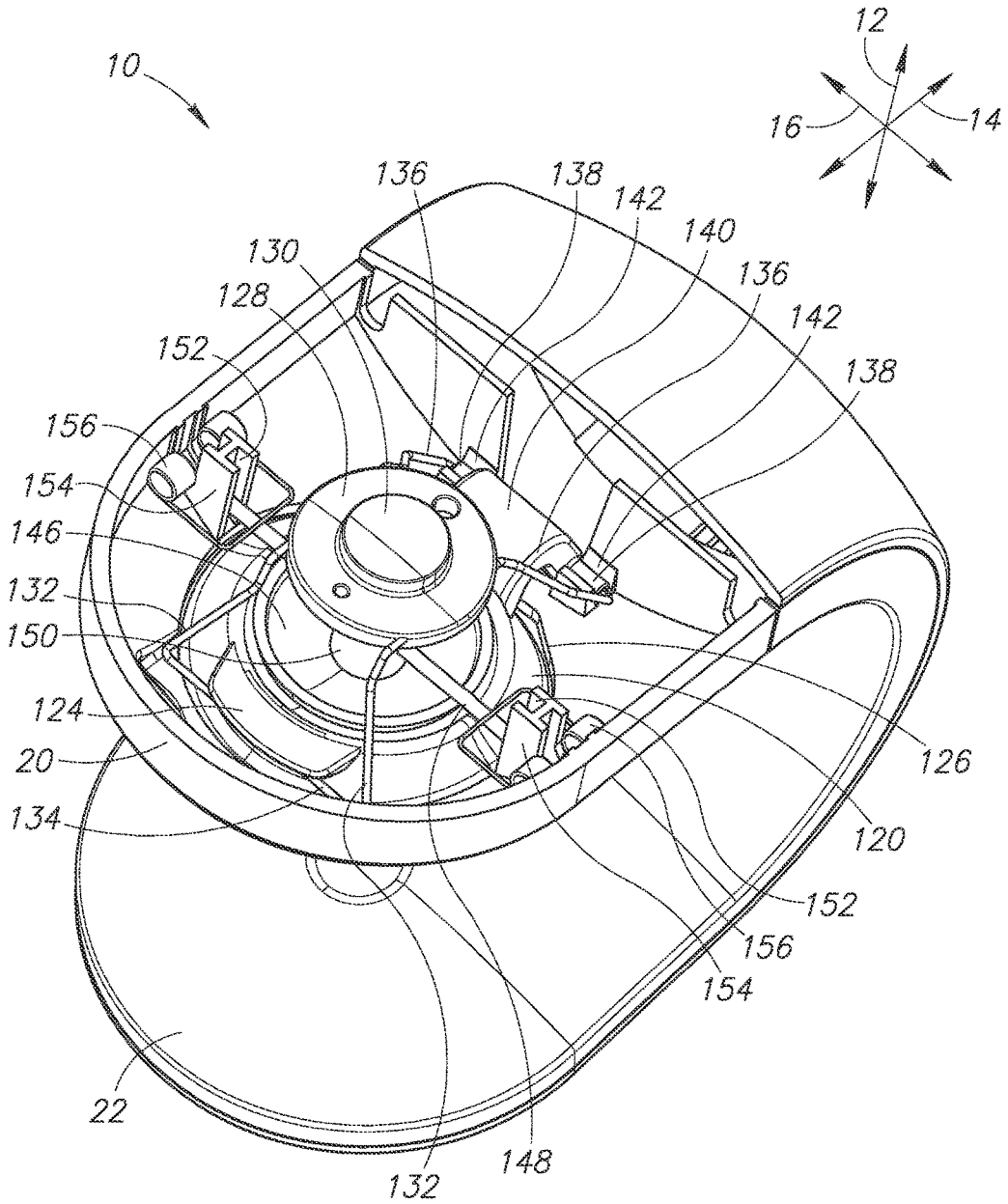
FIG. 9 is an isometric view showing a plunger mechanism of the dispenser of FIG. 8 in accordance with an embodiment of the invention.
Figure 10:
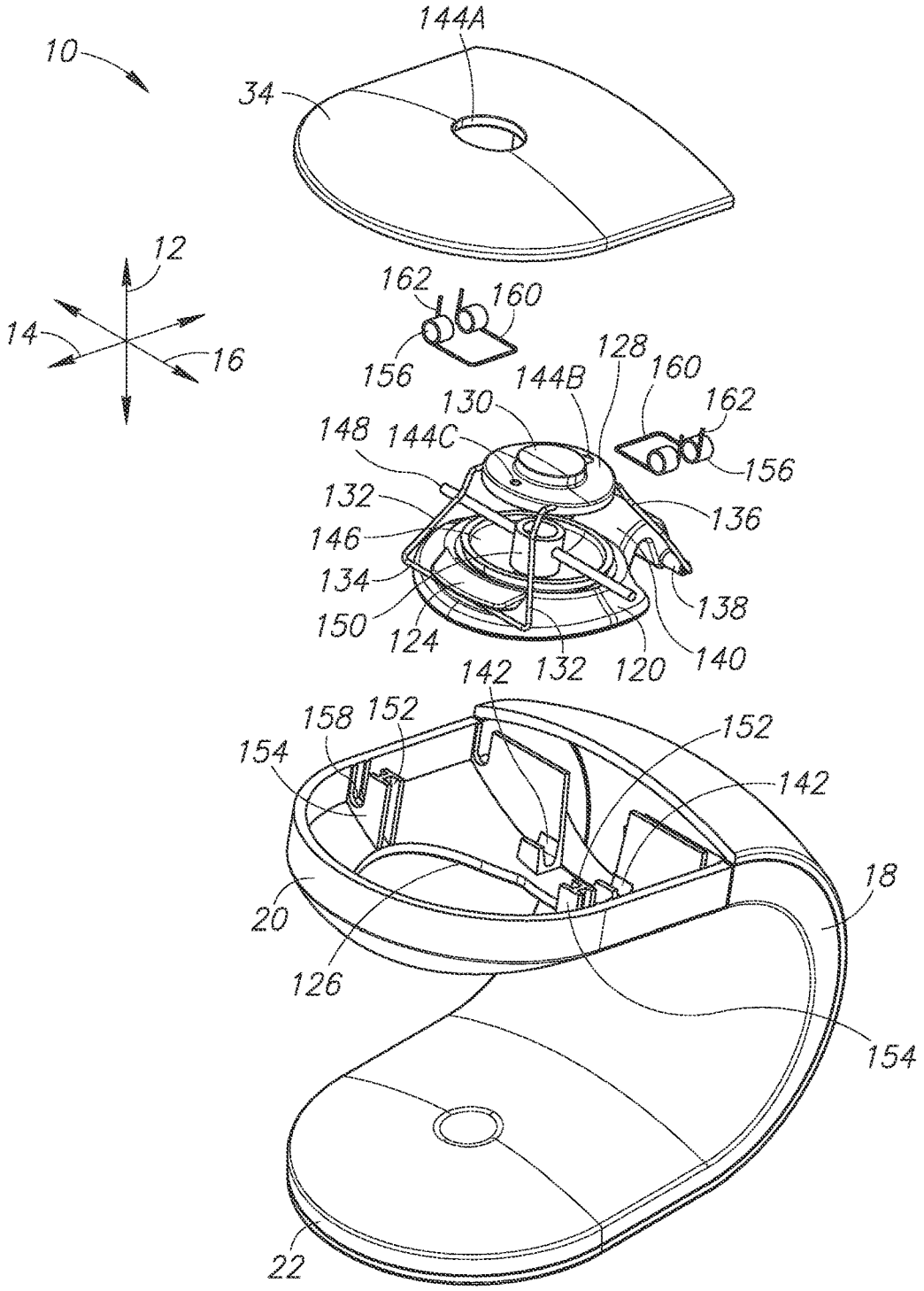
FIG. 10 is a partially exploded view of the dispenser of FIG. 8.
Figure 11:
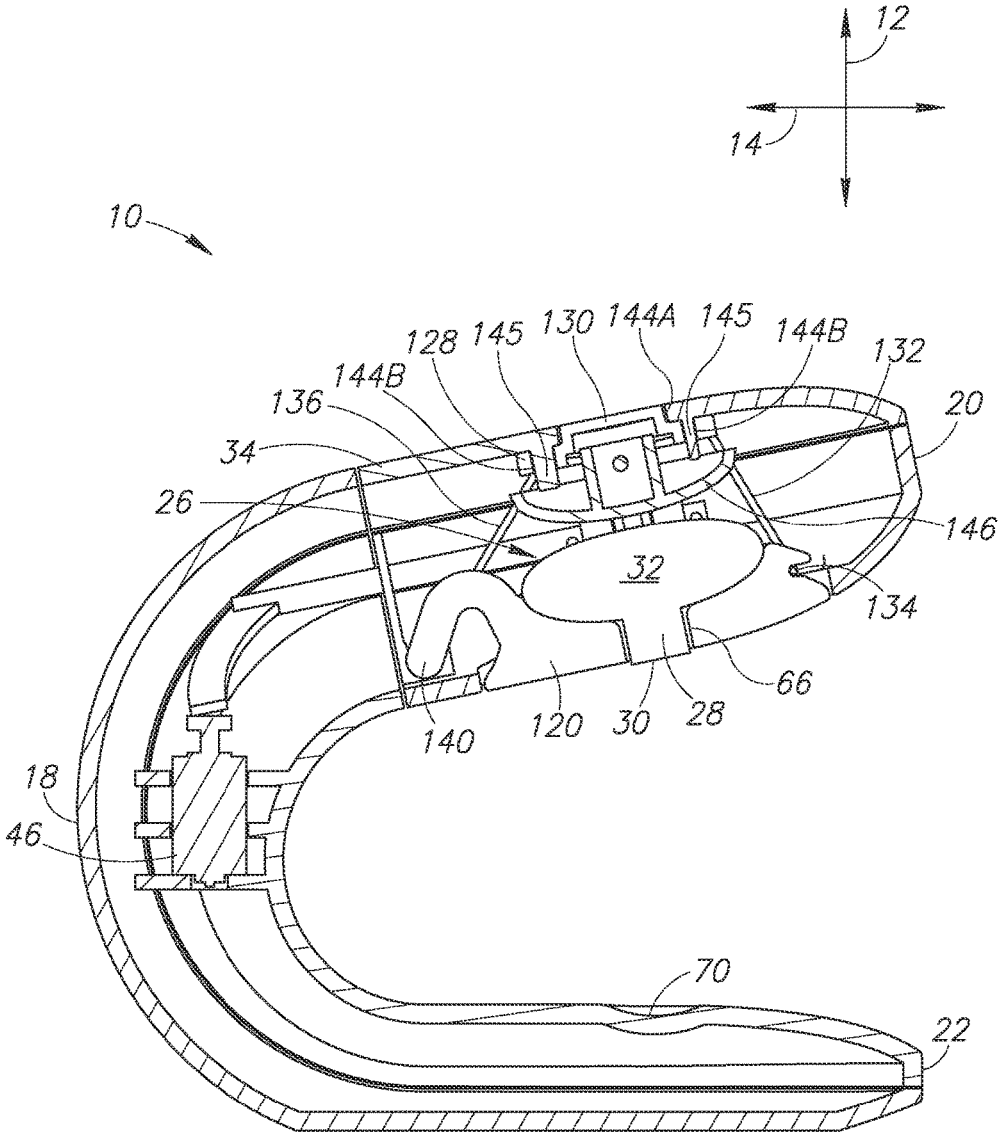
FIG. 11 is a side cross-sectional view of the dispenser of FIG. 8.

Referring to FIGS. 9 to 11, in some embodiments, the reservoir cover 120 may be hingedly secured and releasably secured within an opening 126 covered thereby using the illustrated mechanism. A hub 128 including a registration boss 130 on an upper surface thereof may have front spring arms 132 extending forwardly therefrom in the longitudinal direction 14. The front spring arms 132 may also spread laterally with distance from the hub 128. The spring arms 132 may also be bent downwardly from the hub 128 and secure to a cross bar 134 spanning the distal ends of the front spring arms 132. As shown, the cross bar 134 spans a portion of the opening 126 and engages the ridge 124 in order to retain the cover 120 within the opening 126. The spring arms 132 and cross bar 134 may be made of a resilient material, e.g. spring steel that is capable of deforming to enable the ridge to pass over the cross bar 134. As noted above, the front spring arms 132 may be bent downwardly from the hub 128 such that a vertical gap is present between the bottom of the hub 128, the opening 128, and the upper surface of the cover 120 positioned in the opening 126.

Rear spring arms 136 may secure to the hub 128 and project rearwardly therefrom in the longitudinal direction 14. The rear spring arms 136 may also flair outwardly from one another in lateral direction 16 and be bent downwardly from the hub 128 in the vertical direction 12. The rear spring arms 136 may pivotally secure to axle portions 138 protruding in the lateral direction 16 outwardly from the cover 120. The axle portions 138 may be cylindrical with axes extending in the lateral direction 16. The rear spring arms 136 may include bent end portions insertable within the axle portions 138. The rear spring arms 136 may be retained in engagement with the axle portions 138 due to biasing force of the rear spring arms 136. In some embodiments, the front spring arms 132, rear spring arms 134, and cross bar 134 may be part of a single metal rod or wire bent to the illustrated shape.

The axle portions 138 may be secured to the cover 120 by means of an arm 140 that extends from outside the upper portion 20 to within the upper portion 20. In the illustrated embodiment, the arm 140 is arched such that a concave lower surface thereof spans the edge of the opening 126.

The axle portions 138 may be positioned within seats 142 positioned on either side of the arm 140. As apparent in FIGS. 9 and 10, the seats 142 are open such that insertion and removal of the axle portions 138 from the seats 142. The lid 34 engages the hub 128 and urges the rear spring arms 136 downwardly and accordingly the axle portions 138 into the seats 142. In the illustrated embodiment (see FIG. 10), the lid 34 includes a registration hole 144A receiving the boss 130 formed on the hub 128 in order to maintain the hub 138 in an appropriate location within the cavity 24. In the illustrated embodiment, the registration hole 144A extends completely through the lid 124. In some embodiments, a user may press on the registration boss 130 through the hole 144A in order to depress the hub 128 and urge the cross bar 134 out of engagement with the ridge 124 and allow the reservoir cover 120 to fall out of the opening 126. In some embodiments, the hub 128 may define one or more registration holes 144A, 144B that receive one or more posts 145 (see FIG. 11) secured to an inner surface of the lid 34 or other covering of the upper portion 20.

Pressing of fluid from a reservoir 26 positioned within the cavity 24 may be accomplished by a plunger 146 actuated in substantially the vertical direction 12. In particular, the plunger 146 may move substantially vertically within a gap between the hub 128 and the seat 122 of the cover 120 (see FIGS. 12A and 12B). For example, the plunger may move substantially parallel (e.g. within +/−5 degrees of parallel) to a central axis of the opening 126. In some embodiments, the plunger 146 may be actuated by means of a cross bar 148 that spans the plunger 146 in the lateral direction 16 and may extend laterally outward beyond the plunger 146. In the illustrated embodiment, the cross bar 148 passes through a raised post 150 or tube formed on an upper surface of the plunger 146 (see FIG. 14). The ends of the cross bar 148 may slide within vertical grooves 152 defined in the upper portion 20, one on either side of the opening 126. As is apparent in FIGS. 9-11, the upper portion 20 is at a slight angle, e.g. 2 to 10 degrees, from horizontal. The grooves 152 may likewise be at a similar angle from vertical. The grooves 152 may be understood as parallel to a central axis of the opening 126 or to a direction of travel of the plunger 146. For example, the grooves 152 may be formed in posts 154 positioned on either side of the opening 126. In some embodiments, one or more springs 156 may engage the cross bar 148, or some portion of the plunger 146 or other structure secured thereto (see FIGS. 9 and 10). The springs 156 may bias the plunger toward the opening 126. The springs 156 may include first arms 160 and second arms 162.

Figure 12A:
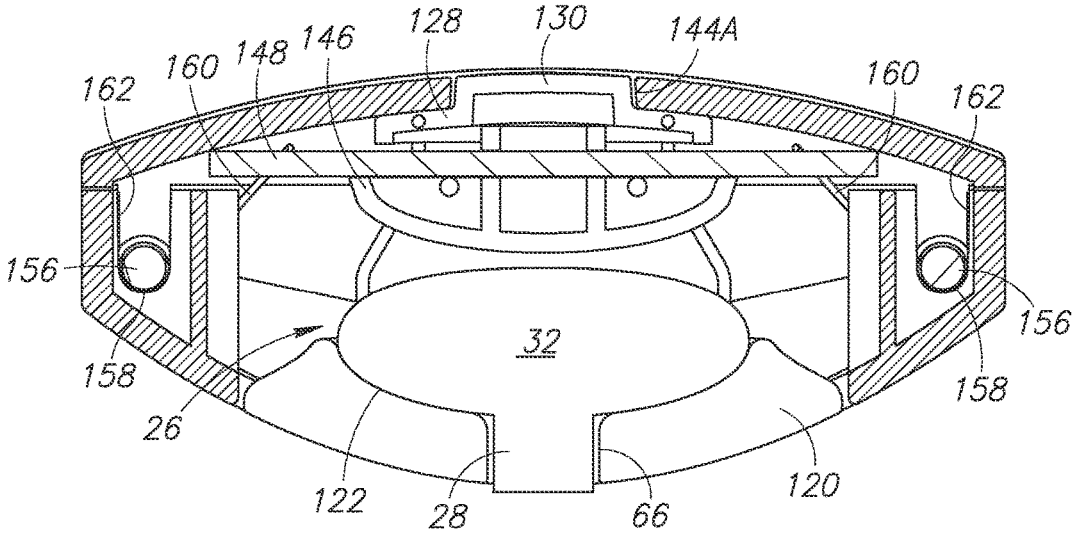
FIGS. 12A and 12B are front cross-sectional views of the dispenser of FIG. 8.
Figure 12B:
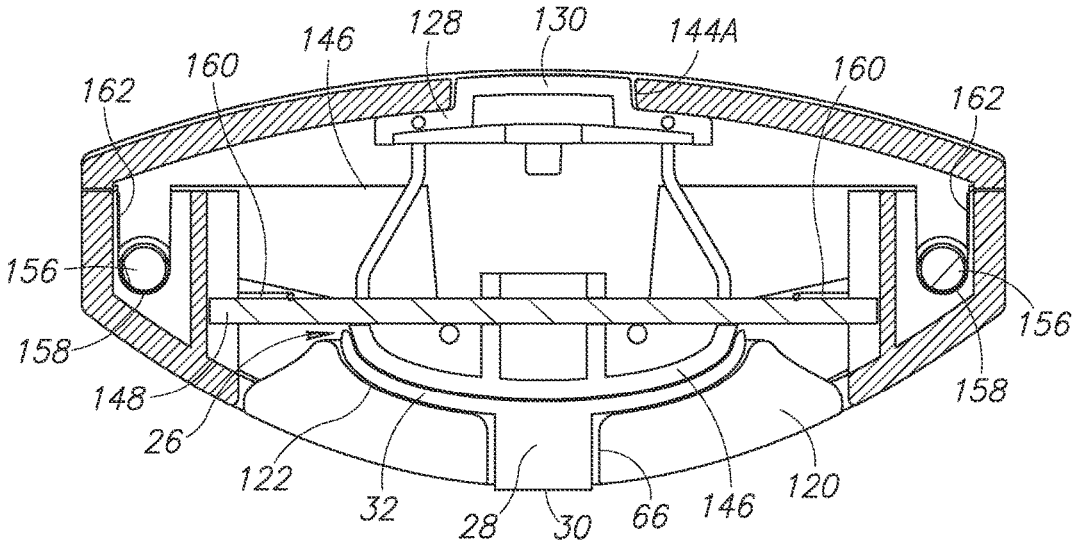

As shown in FIGS. 8 and 12A, when inserting a reservoir 26 within the cavity 24, the user may seat the reservoir 26 on the cover 120 and then urge the cover 120 upward thereby urging the reservoir 26 against the plunger 146. The configuration of FIG. 12A may be a starting position for the plunger 146. As shown in FIG. 12B, upon compression of the plunger 146 toward the cover 120, the body 32 of the reservoir 26 is compressed thereby forcing fluid from the opening 30 until the plunger 146 reaches the end position shown in FIG. 12B. The plunger 146 may be moved between a plurality of discrete positions between the illustrated start and end positions to release discrete amounts of fluid from the reservoir 126 as for other embodiments disclosed herein.

In the illustrated embodiment, the springs 156 may seat within seats 158 positioned laterally outward from the posts 150, however other positions may advantageously be used. As apparent in FIGS. 12A and 12B, the first arms 160 of the springs 156 press against the cross bar 134. The second arm 162 of each spring 156 may engage a portion of the upper portion 20 to counter torque on the arm 160.

Figure 13:
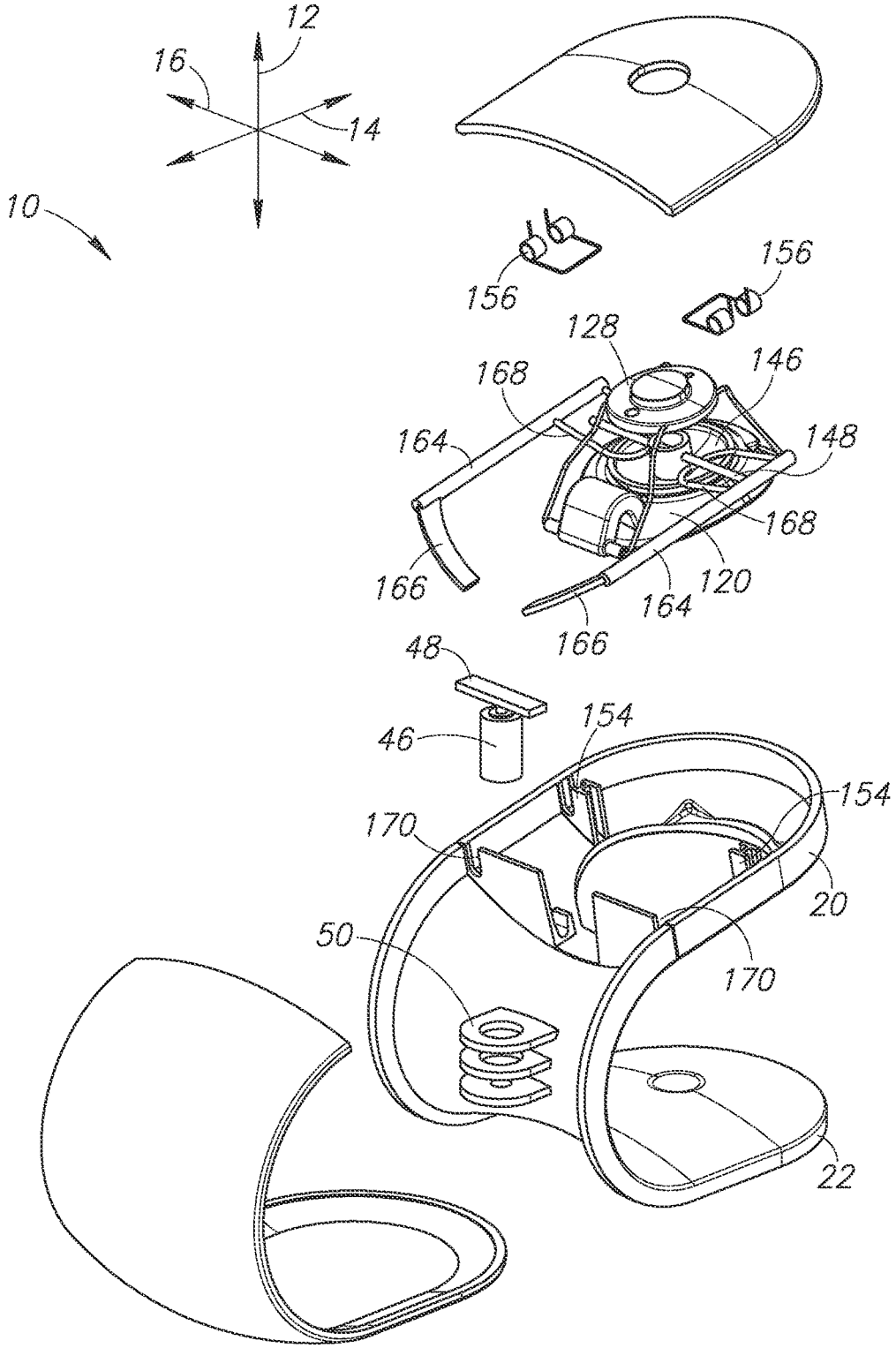
FIG. 13 is another partially exploded view of the dispenser of FIG. 8.
Figure 14:
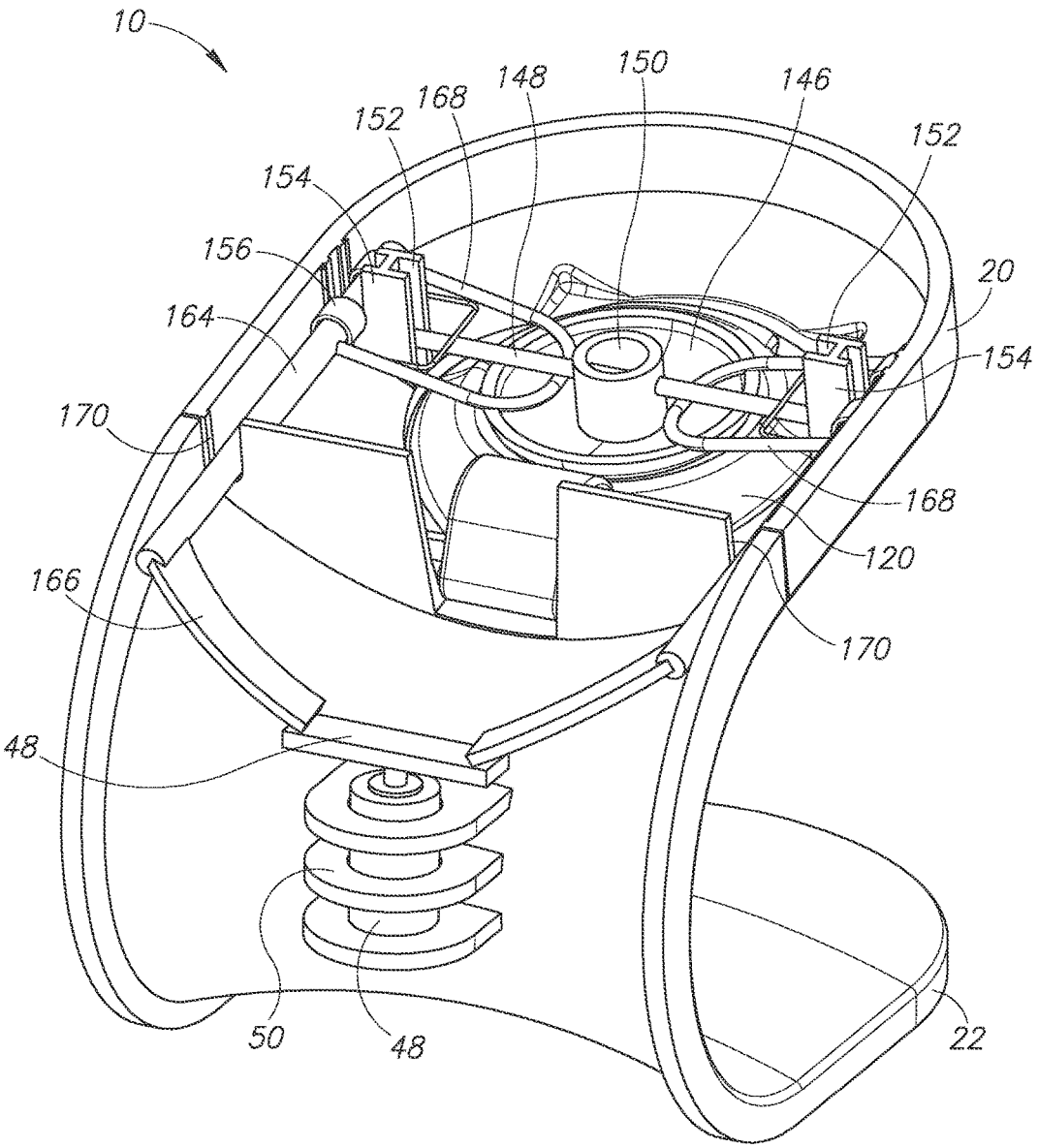
FIG. 14 is an isometric view showing an actuating assembly of the dispenser of FIG. 8 in accordance with an embodiment of the invention.

FIGS. 13 and 14 illustrate an example of an actuation mechanism that may be used to drive the plunger 146. The springs 156 may be considered part of the actuation mechanism. The actuation mechanism may include rods 164 extending along the upper portion such as in a generally longitudinal direction 14 that slopes upward similarly to the upward angle of the upper portion 20. The rods 164 may include first arms 166 secured to first end portions thereof that engage the linear actuator 46, such as by means of the spreader 48 driven up and down by the linear actuator 46. The rods 164 may include second arms 168 secured at second end portions opposite the first end portions. The rods 164 may seat within slots 170 defined by the upper portion 20.

The second arms 168 extend over the plunger 146 such that in response to rising of the arms 166, the arms 168 are also raised. In the illustrated embodiment, the arms 168 are loops that extent around the posts 154 and between the cross bar 134 and the plunger 146. As is apparent, the actuator 46 may only be able to force the arms 166 up. Accordingly, the arms 168 may be operable to counter the force of the biasing springs 156 to enable insertion of a reservoir 26. To dispense fluid, the actuator 46 may lower the spreader 50 to a different position thereby allowing the biasing force of the springs 156 to force fluid from the reservoir 26. In some embodiments, the actuator 46 may be coupled to the arms 166 such that the actuator 46 is able to force both raising and lowering of the arms 166, 168. In still other embodiments, springs 156 may urge the plunger 146 up and the actuator 46 is operable to urge the plunger 146 downward toward the cover 120. As shown in FIG. 14, in some embodiments, the rods 164 may pass through coils of the springs 156.

The embodiment of FIGS. 9 to 14 may likewise include a controller 62, proximity sensor 52, and lights 56 configured similar to the embodiment of FIGS. 1 to 4. As for other embodiments disclosed herein, the controller 62 may be configured to advance the plunger 146 between discrete positions in response to detecting proximity using the proximity sensor 52. Likewise, the controller 62 may be configured to return, or allow the return, of the plunger 146 to the start position upon reaching the end position. The embodiment of FIGS. 9 to 14 may likewise include a heating element 74 in thermal contact with the reservoir 26, cavity 24, or air within the upper portion 20.

Figure 15:
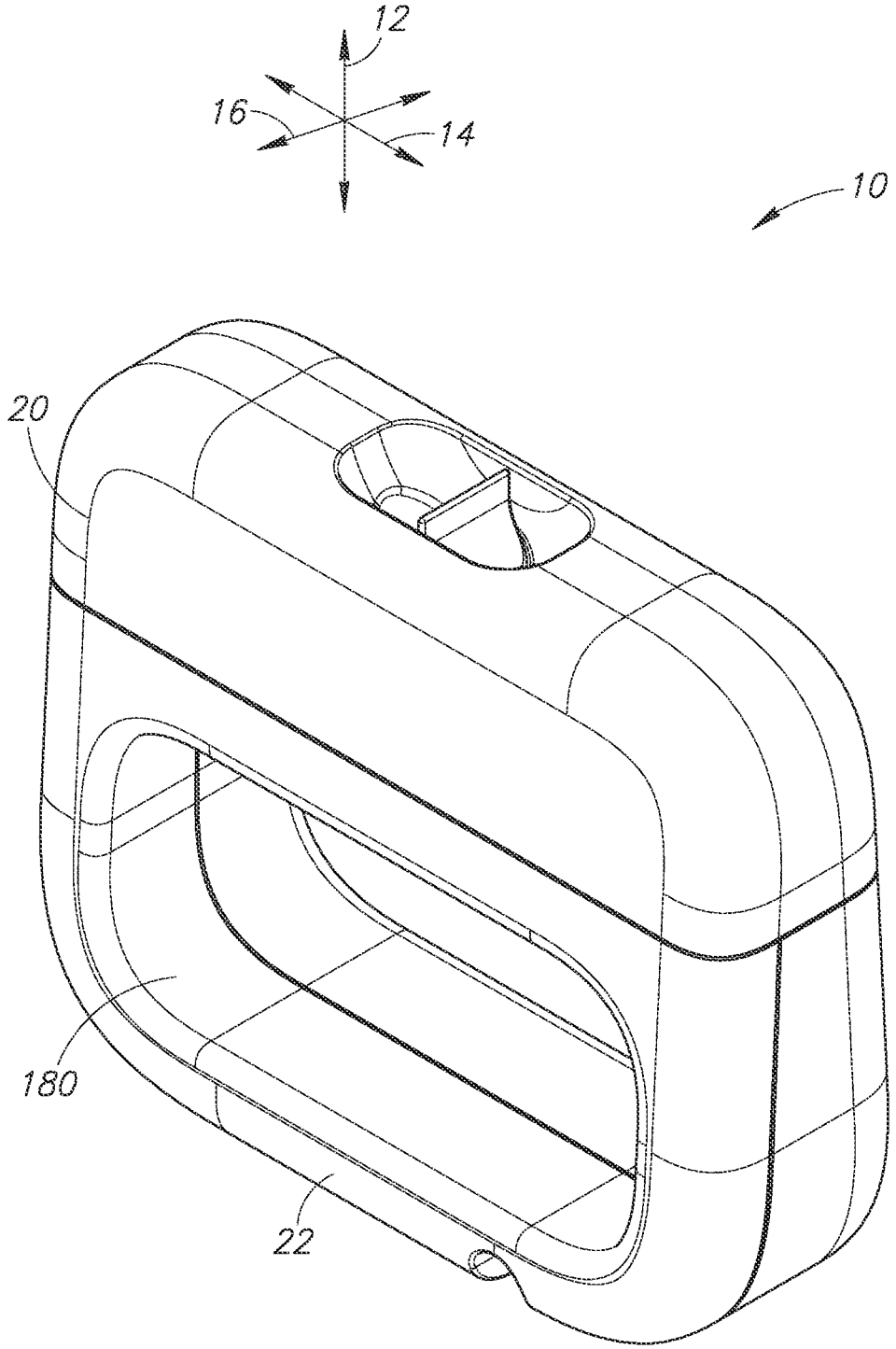
FIG. 15 is an isometric view of a fourth embodiment of a dispenser in accordance with an embodiment of the invention.
Figure 16:
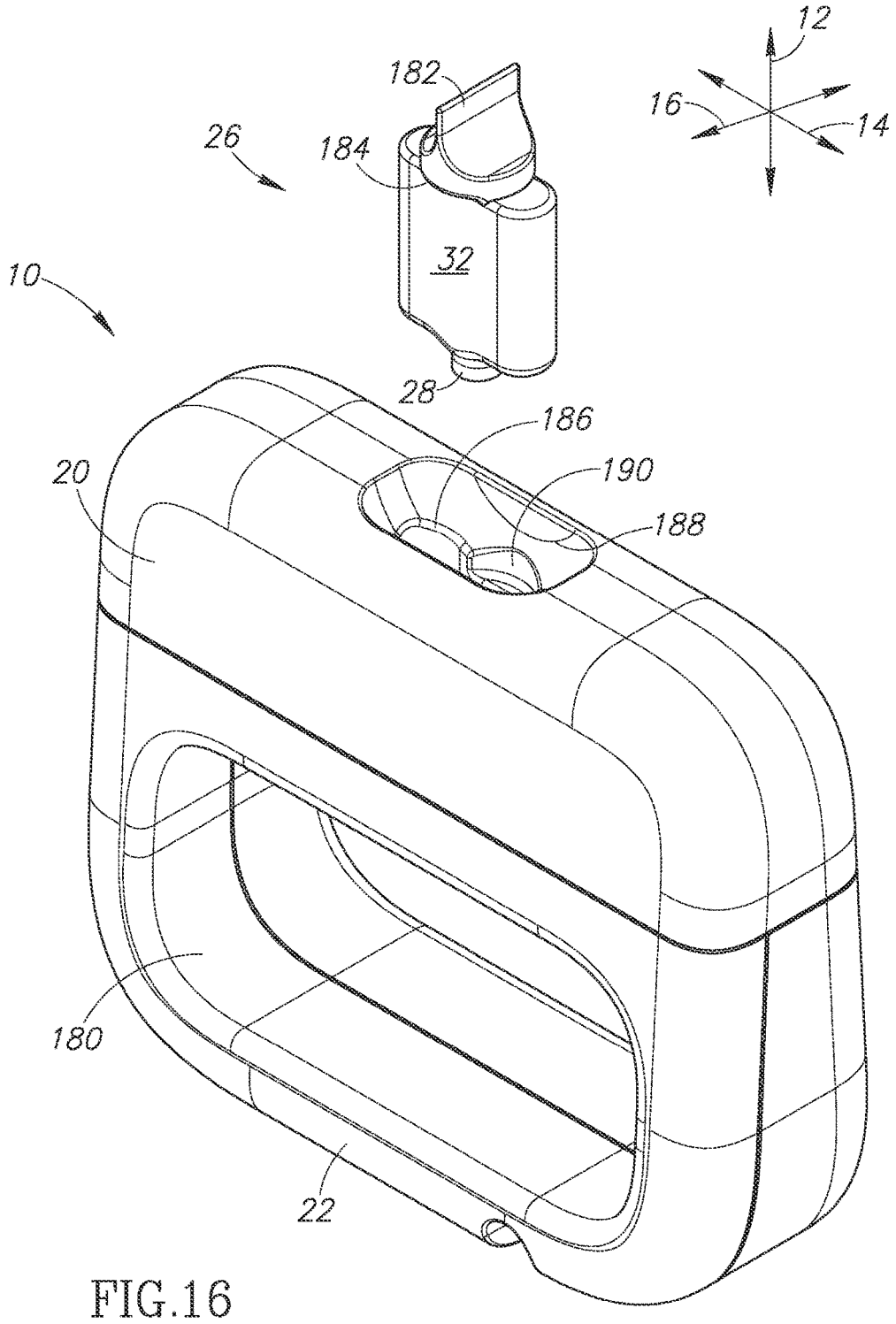
FIG. 16 is an isometric view showing the dispenser of FIG. 16 and a fluid reservoir in accordance with an embodiment of the invention.

Referring to FIGS. 15 and 16, in some embodiments, the upper portion 20 and lower portion 22 may have the illustrated configuration. In particular, rather than having being C-shaped, the upper portion 20 and lower portion 22 may join at both ends to define an opening 180 for receiving a portion of a user's hand. The embodiment of FIGS. 15 and 16 may be used with the illustrated reservoir 26. As shown, the body 32 of the reservoir 26 may have a substantially constant cross section along the height thereof. A handle 182 may be secured to the body 32 opposite the neck 28 to facilitate removal of the reservoir 26. A lip or shoulder 184 may protrude from the handle 182 and extends outwardly from the body 32.

The upper portion 20 may define an opening 186 for receiving the reservoir 26 and include a sloped surface 188 surrounding the opening 186 to guide the reservoir 26 into the opening 186. A seat 190 shaped to engage the shoulder 184 may also be positioned adjacent the opening 186.

Figure 17A:
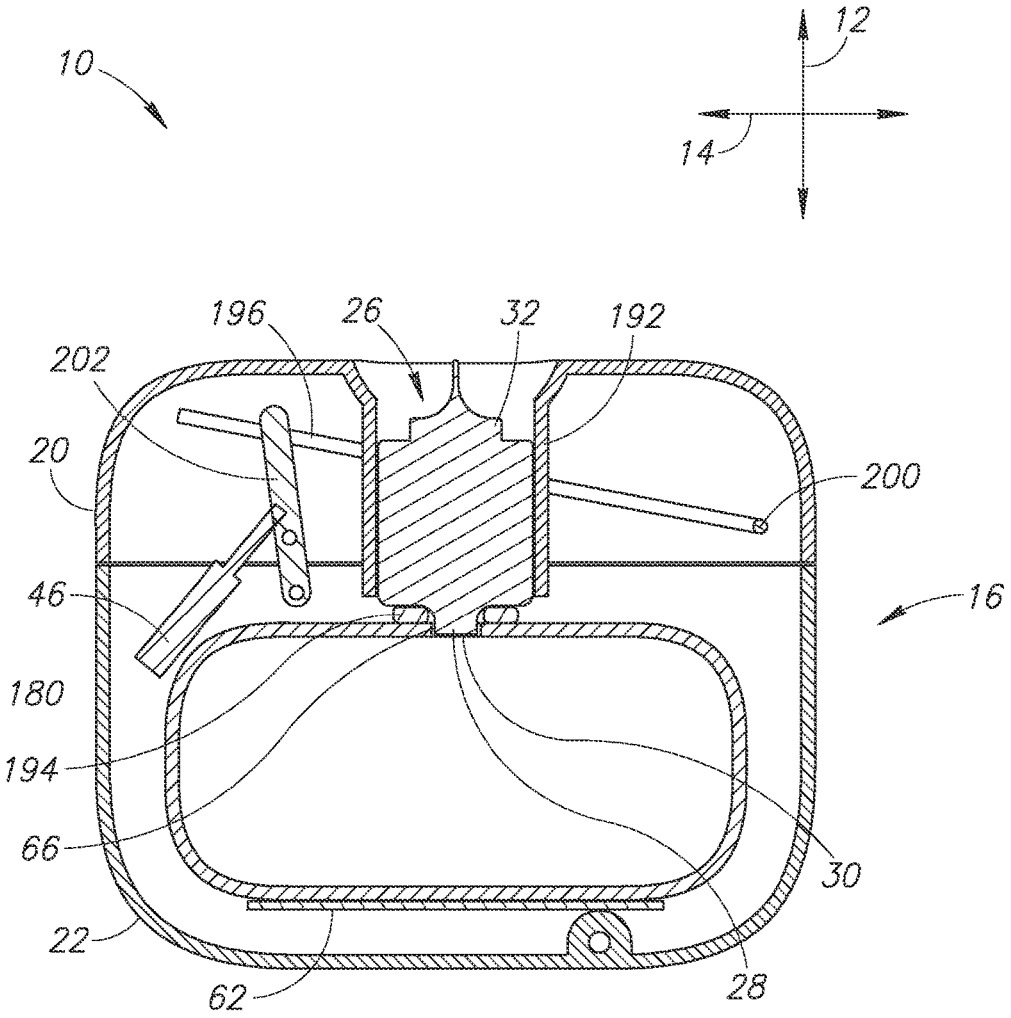
FIGS. 17A to 17C are cross-sectional views of the dispenser of FIG. 16.
Figure 17B:
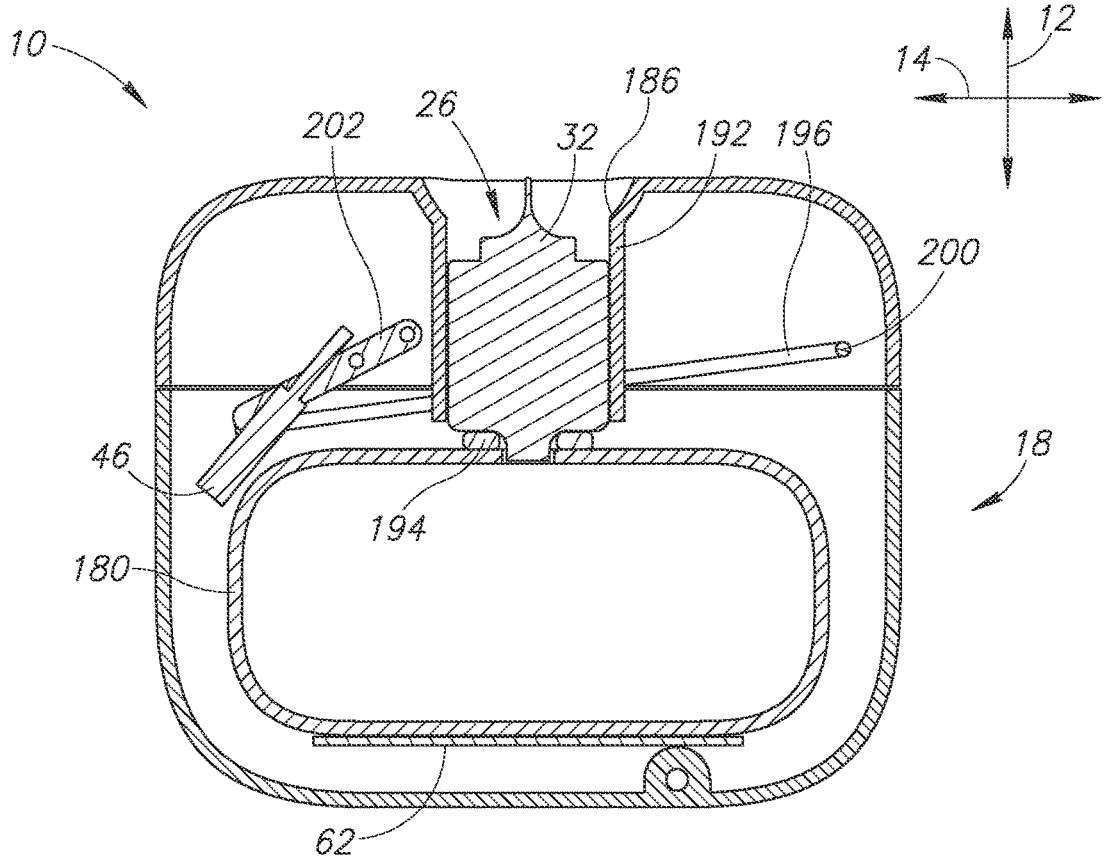
Figure 17C:
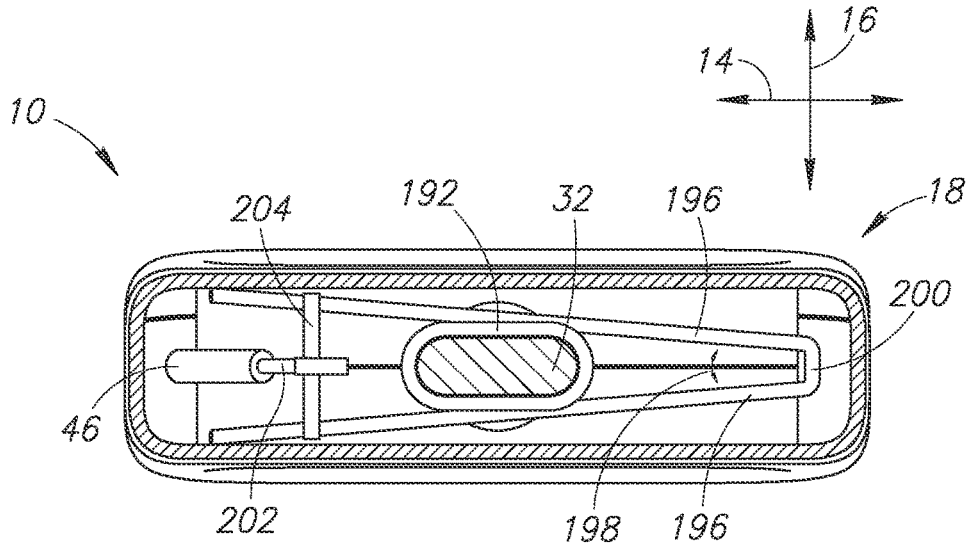

Referring to FIGS. 17A to 17C, in some embodiments the opening 186 may be defined by a flexible sleeve 192 secured to the upper portion 20. The sleeve may be open at both ends such that the neck 28 of the receiver 26 may pass there through and insert within the opening 66. In some embodiments, a washer 194 may be positioned above the opening 66 and the neck 28 may insert there through.

In the illustrated embodiment, fluid is forced from the reservoir 26 by arms 196 positioned on either side of the flexible sleeve 192. The sleeves may define an angle 198 between them. The sleeves may be pivotally secured at a pivot 200 on one side of the sleeve 192 to the housing 18 and pass on to an opposite side of the sleeve 192 having the sleeve 192 positioned there between. The arms 196 may be part of a single metal rod bent to the illustrated shape including a straight portion defining the pivot 200. Opposite the pivot 200, a link 202 may pivotally mount within the housing 18 and to the arms 196, such as by means of a cross bar 204 secured to both bars arms 196. The actuator 46 may pivotally secure to the link 202, such as at a point between the points of securement of the arms 196 to the link 202 and a point of securement of the link 202 to the housing 18. However, the actuator 46 may also be coupled to the link 202 at another point along the link 202. The actuator 46 may be pivotally mounted to the housing 18 as well such that the actuator 46 pivots during actuation thereof.

As shown in FIGS. 17A and 17B, the actuator 46 may shorten thereby drawing the arms 196 down over the flexible sleeve 192 and forcing fluid out of the opening 30. As for other embodiments, the actuator 46 may move the arms 196 between discrete positions from a start position (FIG. 17A) to an end position (FIG. 17B). The controller 62 may cause the actuator 46 to return the arms 196 to the start position upon the arms 196 reaching the end position. In the illustrated embodiment, the controller 62 is positioned below the opening 180.

The embodiment of FIGS. 15 to 17C may likewise include a controller 62, proximity sensor 52, and lights 56 configured similar to the embodiment of FIGS. 1 to 4. As for other embodiments disclosed herein, the controller 62 may be configured to advance the arms 196 between discrete positions in response to detecting proximity using the proximity sensor 52. Likewise, the controller 62 may be configured to return, or allow the return, of the arms 196 to the start position upon reaching the end position. The embodiment of FIGS. 15 to 17C may likewise include a heating element 74 in thermal contact with the reservoir 26, cavity 24, or air within the housing 18.

Figure 18:
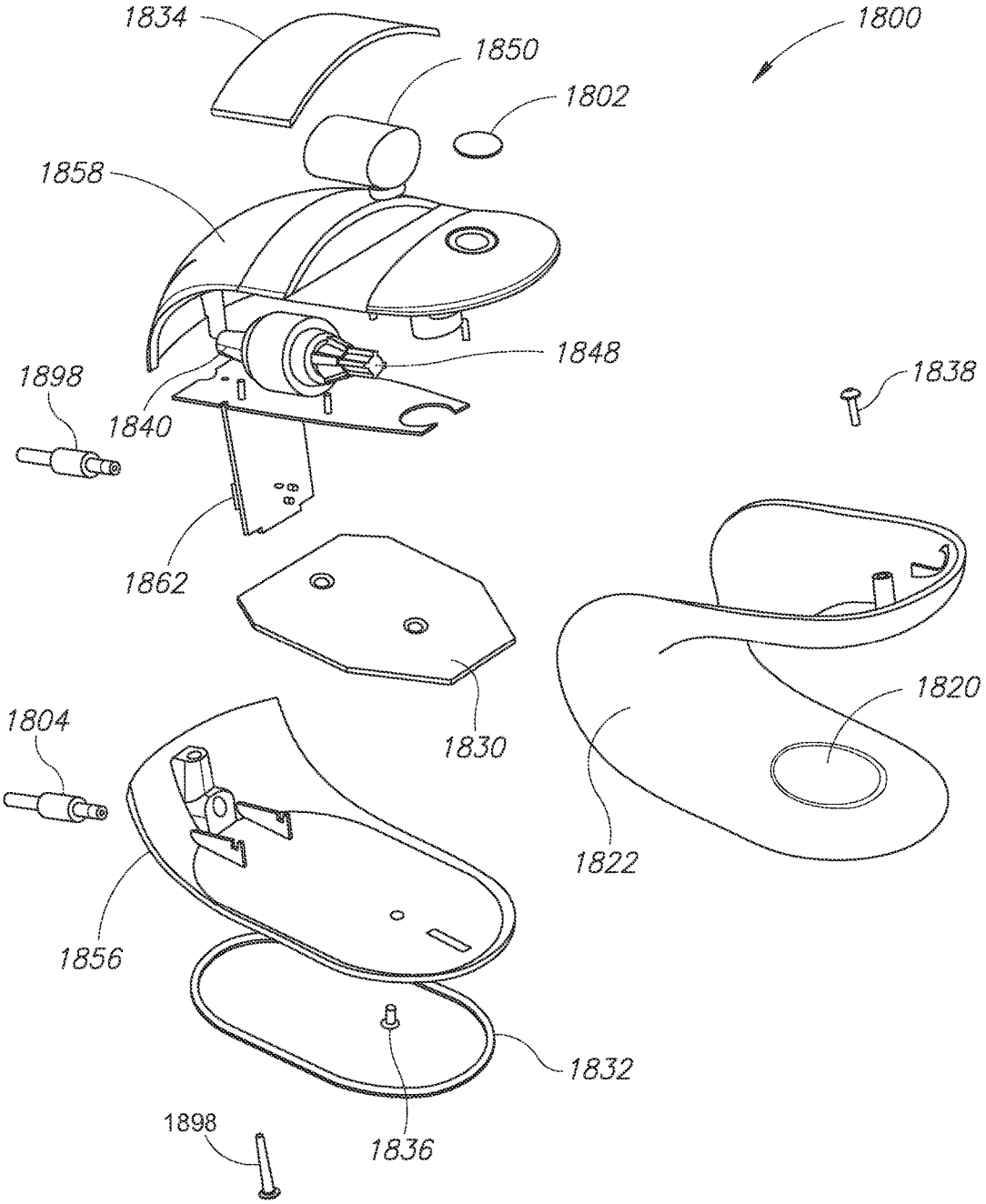
FIG. 18 illustrates an exploded view of pneumatically driven fluid dispenser 1800, consistent with the embodiments disclosed herein.

FIG. 18 illustrates an exploded view of pneumatically driven fluid dispenser 1800, consistent with the embodiments disclosed herein. Dispenser 1800 includes a housing. Housing includes front piece 1822, upper piece 1858, and base piece 1856. Front piece 1822 includes a gap to receive at least one hand of a user to intercept the fluid dispensed from dispenser 1800. In some embodiments, dispenser's 1800 housing includes a rubber foot 1832 and a base weight

1830, installed on the base portion to stabilize dispenser 1800 when it is resting on a surface, such as a nightstand or table.

Housing also includes a removable or slidable lid 1834 to conceal the receptacle, cavity, or compartment that removably receives fluid reservoir 1850. Dispenser 1800 includes a removable power cord 1804 to provide electrical power. In some embodiments, external sources provide dispenser 1800 with compressed gas or fluid to provide an actuating force. In such embodiments, dispenser 1800 includes a removable pneumatic source, such as compressor hose 1898.

Dispenser 1800 includes circuit board 1862. Circuit board 1862 includes various electronic devices and/or components to enable operation of dispenser 1800. Such devices and/or components may include, but are not limited to processor devices and/or microcontroller devices, diodes, transistors, resistors, capacitors, inductors, voltage regulators, oscillators, memory devices, logic gates, and the like. Dispenser 1800 includes switch 1802.

Dispenser 1800 includes an actuator 1840. In various embodiments, the actuator 1840 includes drive shaft 1848. In a preferred embodiment, as described in the context of FIG. 20, actuator 1840 is a pneumatically driven actuator. However, other embodiments are not so constrained and actuator 1840 may be drive by electrical power. Drive shaft 1846 provides the translation to dispense fluid from fluid dispenser 1800.

Various fasteners and couplers including but not limited to fasteners 1898, 1836, and 1838, couple the components of dispenser 1800. Dispenser 1800 includes containment depression 1820. Containment depression 1820 contains and/or retains any fluid dispensed not intercepted by a user's hand. In a preferred embodiment, containment depression 1820 is included in front piece 1822.

Figure 19:
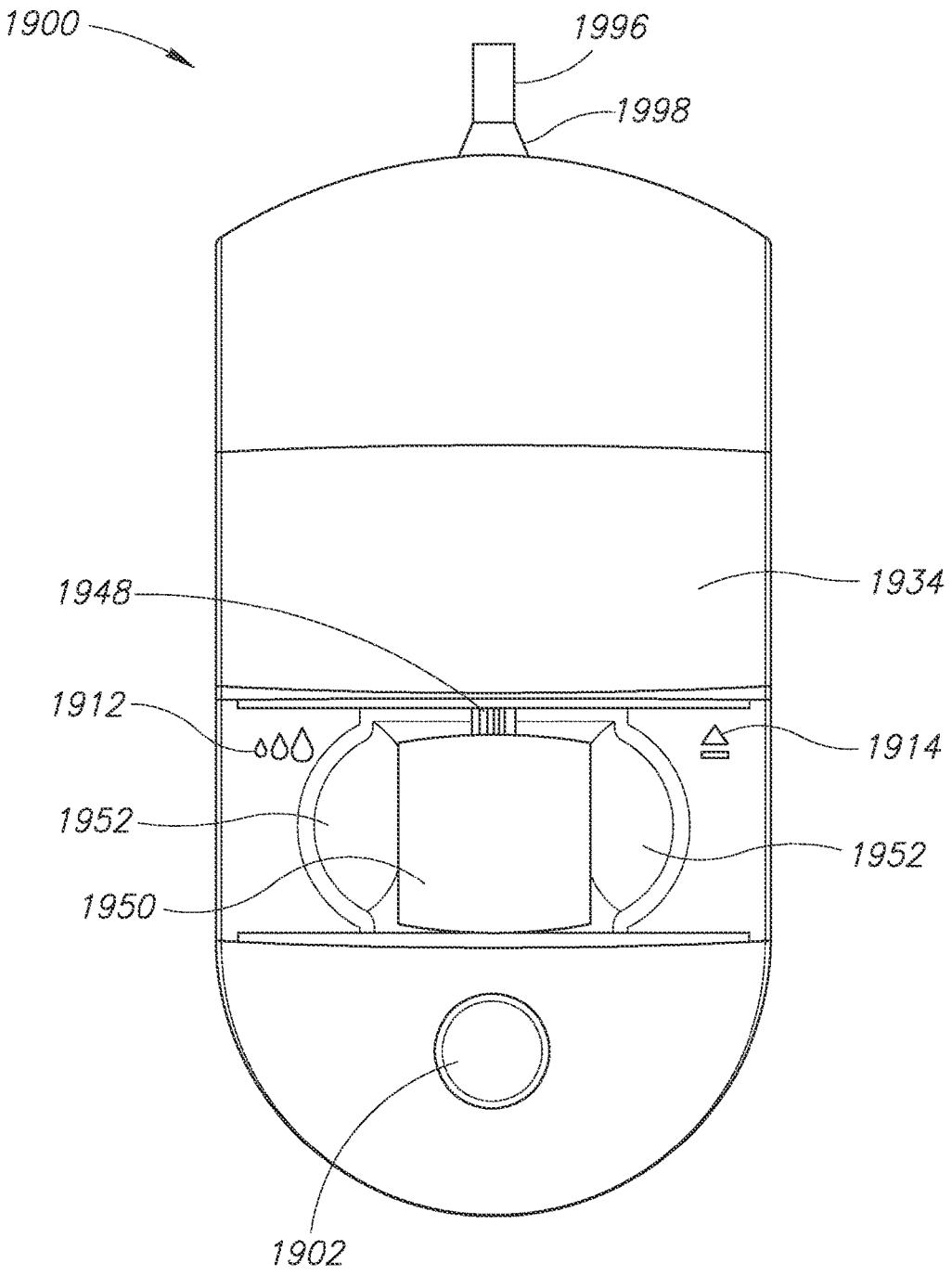
FIG. 19 illustrates a top view of another embodiment of a dispenser consistent with the embodiments disclosed herein.

FIG. 19 illustrates a top view of another embodiment of a dispenser consistent with the embodiments disclosed herein. Lid 1934 is open to reveal a fluid reservoir, such as the fluid reservoir 1850 of FIG. 18. Dispenser 1900 removably receives fluid reservoir 1950. An actuator in dispenser 1900 includes driveshaft 1948 to translate a displaceable piston included in reservoir 1950. In some embodiments, the actuator includes a device that converts electrical energy into mechanical work, such as an electric motor. In preferred embodiments, the actuator uses a pneumatic source, such as compressed air or gas to drive or translate driveshaft 1948. At least one embodiment employs hydraulics to drive driveshaft 1948.

In some embodiments, the pneumatic source is internal to the housing of dispenser 1900. In other embodiments, the pneumatic source is external to fluid dispenser 1900. Embodiments that include an external pneumatic source may include a pneumatic input port 1998 to connect pneumatic hose 1996 to dispenser 1900. The other end of pneumatic hose 1996 (not shown) is connected to a compressed air source to deliver compressed air to the actuator and translate driveshaft 1948.

Dispenser 1900 includes a power supply and/or power source. In a preferred embodiment, the power source provides alternating current to dispenser 1900. Other embodiments are not so constrained and can operate with a DC power supply, such as an internal battery. The power supply may include a power cord, such as removable power cord 1804 of FIG. 18. The power cord provides electrical power from an external supply to dispenser 1900. The supplied power is employed by various components of dispenser 1900, including but not limited to a processor device, the actuator, an embedded nightlight, as well as various user interfaces and user selection devices. Power cord may include a wall-plug AC adapter, employing prongs for North America, Europe, Asia, or any other such regions. Finger trenches 1952 assist in inserting and removing reservoir 1950 from the fluid reservoir receptacle or cavity of dispenser 1900.

Various user controls and/or user interfaces are included in dispenser 1900. At least one of the controls may be a touch sensitive control or sensor. Touch sensitive controls may be capacitive touch sensors. Touch sensitive sensors, controls, or components may be housed within dispenser's 1900 housing. The touch sensitive components can sense at least one of a touch, proximity of, or motion of a user's hand through housing. In preferred embodiments, sensing the proximity or motion of a user's hand underneath the dispensing aperture triggers a dispensing event and causes dispenser 1900 to dispense a portion of the fluid housed within fluid reservoir 1950. For instance, when a user places a hand underneath the dispensing aperture, a proximity sensor may trigger the dispensing mechanism such that a predetermined volume of fluid is dispensed onto the user's hand.

A dispensing event or trigger dispenses a predetermined volume of fluid from reservoir 1950 and out through dispenser 1900 by translating driveshaft 1948 a predetermined distance. The predetermined distance corresponds to the predetermined volume. In at least one embodiment, dispenser 1900 includes a timer. The timer may prevent a dispensing event from occurring unless a lockout time has elapsed since the previous dispensing event. This lockout mode limits a dispensing frequency of dispenser 1900. Accordingly, the likelihood of a user accidentally triggering multiple dispensing events is minimized. The lockout time or maximum dispensing frequency may be programmed by a user employing various user controls or selectors.

Other touch sensitive or proximity/motion controls or sensors include at least one of a volume selector 1912, or ejector 1914. Some of the user controls may be marked by an indicator or icon, such as volume selector 1912 or ejector 1914 icon, to indicate the functionality of the corresponding user control. Some of the user controls or icons may be illuminated with electromagnetic energy sources, such as LEDs to indicate a user's selection or other functionality.

At least one of the user controls, such as volume selector 1912 or ejector 1914, may be a touch-sensitive control that varies a user selection when a user touches their finger to the touch-sensitive control. In preferred embodiments, the electromagnetic sources that illuminate various control icons are LEDs. Some of the LEDs may emit different colors. For example, at least one red LED, at least one greed LED, and at least one blue LED may be included in dispenser 1900 to provide a light source. Various colors of visible light may be generated by blending red, green, blue (RGB) components.

The user may select the dose of fluid to be dispensed by dispenser 1900. In a preferred embodiment, the user may select one of multiple predetermined volumes to be dispensed. In the embodiment illustrated in FIG. 19, three predetermined volumes are available, such as a small, a medium, or a large dose, as indicated by the three differently sized fluid drop icons of volume selector 1912.

Volume selector 1912 is a touch sensitive user control, and thus a user can touch the fluid drop icon sized to correspond to the desired dose. Alternatively, with each touch of the icon, the dose selection cycles to the next amount, illuminating the selection. Thus, each of the small, medium, and large drop indicators may include an individual LED. The currently selected volume may be indicated by illuminating the corresponding fluid drop icon by activating the appropriate LED. In other embodiments, a continuous selection of volumes to be dispensed is available. In such embodiments, volume selector 1912 is a continuously variable slide control touch sensitive selector.

Dispenser 1900 varies the volume dispensed by dispenser 1900 in a single dispensing event by varying the length that driveshaft 1948 translates the piston in fluid reservoir 1950 due to triggering the actuator. Because in preferred embodiments, the cross section of reservoir 1950 is uniform, the amount of fluid dispensed in one dispensing event is linearly proportional to the length that the piston is translated. Accordingly, dispenser 1900 varies the length that the driveshaft 1948 is driven in one dispensing event based on a user selection of volume selector 1912.

Ejector 1914 may be a touch sensitive control. When ejector 1914 is activated, driveshaft 1948 is translated away from the driven mechanism of reservoir 1950 and backed away from reservoir 1950 to allow the user to remove reservoir 1950 from dispenser 1900. As mentioned above, in a preferred embodiment, driveshaft 1948 is translated by a pneumatic source. In at least one embodiment, dispenser 1900 includes a spring-loaded mechanism to automatically eject reservoir 1950 when driveshaft 1948 has cleared the body of reservoir 1950. A spring-loaded mechanism may return driveshaft 1948 to its initial configuration when ejector control 1914 is activated.

In some embodiments, when driveshaft 1948 has cleared the body of reservoir 1950, an LED included in ejector 1914 is illuminated to indicate that a user may safely remove reservoir 1950. In other embodiments, an LED embedded within or proximate to the receiving receptacle is activated to indicate that reservoir 1950 may be safely removed. If the body of reservoir 1950 is transparent or translucent, any remaining fluid within reservoir 1950 may be illuminated. In other embodiments, this LED embedded in the receiving receptacle may indicate other functionalities. By using finger trenches 1952, a user may easily and safely remove reservoir 1950 from dispenser 1900.

Other indicators included in dispenser may indicate when serve to indicate modes or functionality of dispenser 1900. For instance, an indicator or icon may indicate that reservoir 1950 is approaching an empty state and thus needs to be replenished or replaced. Other indicators may indicate an error state of dispenser 1900. An embedded nightlight may serve as one or more indicators. In addition to serving as an on/off control, switch 1902 may serve as a mode of functionality indicator and/or an embedded nightlight.

Figure 20:
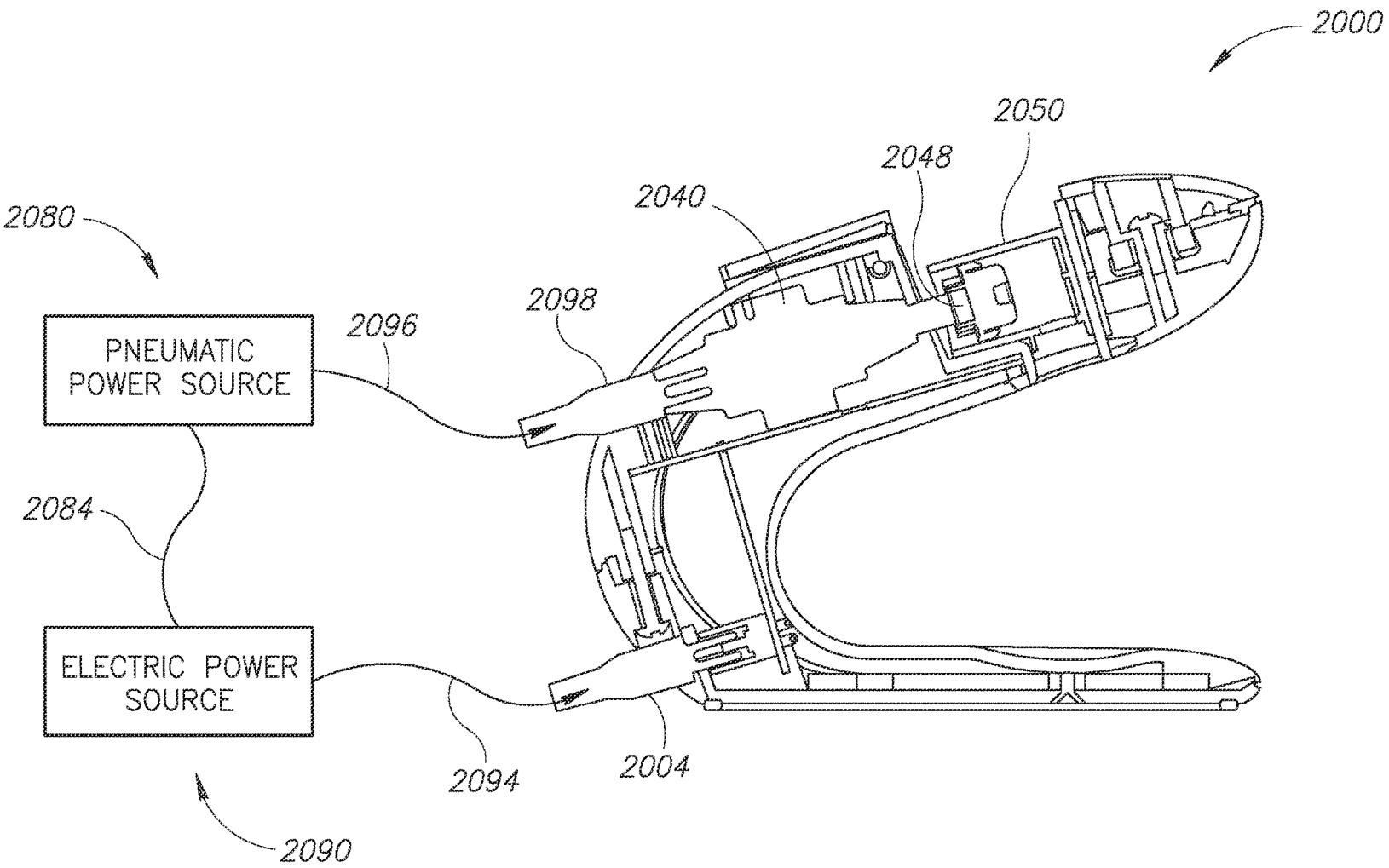
FIG. 20 illustrates a cutaway side view of a pneumatically driven fluid dispenser 2000 that is consistent with the embodiments disclosed herein.

FIG. 20 illustrates a cutaway side view of a pneumatically driven fluid dispenser 2000 that is consistent with the embodiments disclosed herein. Actuator 2040 is actuated with pneumatic power source 2080 that is external to the housing of fluid dispenser 2000. Actuator 2040 may include a driveshaft to drive a piston 2048 that is internal to a received fluid reservoir 2050.

Fluid dispensers that are pneumatically actuated or driven may be more reliable than dispensers that are actuated by an electric motor. Pneumatically actuated dispenser may not need an electric motor. For instance, a pneumatically actuated dispenser may employ commercially available compressed air, such as those available in canisters. Some common sources of commercially available compressed air include "canned air," as well as canisters typically sold to inflate tires, such as a bicycle or motorcycle tire. Other pneumatically actuated dispensers may employ an air compressor that uses an electric motor to condense air. Furthermore, because any discreet amount of compressed air may be delivered in a single actuator event, the amount of fluid dispensed in a single trigger of the actuator need not be quantized based on the configuration of a stepper motor. Pneumatically actuated dispensers may be used in a medical, laboratory, or academic setting, as well as in another other setting, including a consumer's residence.

Dispenser 2000 receives fluid reservoir 2050 in a fluid reservoir receptacle or cavity. The receptacle is shaped to snuggly receive, hold, and stabilize reservoir 2050. External pneumatic power source 2080 includes a compressor to compress or pressurize gas, such as air. Although, as stated above, the invention is not so constrained and other sources of compressed air may be employed as pneumatic power source 2080.

In the embodiment shown in FIG. 20, the pneumatic power source 2080 is external to dispenser 2000. However, various embodiments are not so constrained and the pneumatic power source may be internal to the housing of fluid dispenser 2000. An internal pneumatic power source may include an air compressor that employs an electric motor. Other internal pneumatic power sources may be a canister or reservoir of compressed air that is removably received within the housing of dispenser 2000, similar to fluid reservoir 2050. A hose, such as pneumatic hose 2096 provides the pressurized gas to actuator 2040 through pneumatic input port 2098. Accordingly, external pneumatic power source 2080 may be positioned behind a nightstand or below a table that supports dispenser 2000, depending on the length of pneumatic hose 2096.

External electric power source 2090 provides electrical power to dispenser 2000 and pneumatic source 2080. A conductive pathway, such as power cord 2094 electrically couples electric power source 2090 with dispenser 2000, through electrical input port 2004. Electric power source 2090 may provide alternating current to dispenser 2000 to power various components of dispenser 2000, including at least actuator components, a microprocessor device, and a nightlight. Likewise, power cord 2084 electrically couples electric power source 2090 with pneumatic power source 2080. The electrical power provided to pneumatic power source 2080 may drive the compressor to generated gas that is at a greater pressure than the ambient pressure. Pneumatic power source 2080 may include a reservoir or tank to contain the generated pressurized gas.

Other embodiments are not so constrained, and the electric power source may be an internal electric power source, such as a battery. Embodiments that include a battery for the electric power source and a pre-packaged canister or reservoir or compressed air rather than employing an air compressor may be employed anywhere regardless of the availability of an external electric power source, such as an AC wall outlet. The pre-packaged canister of air may be housed either internal or external in relation to the dispenser's housing.

While the preferred embodiments of the invention have been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A dispenser comprising:

a housing defining a longitudinal direction, a horizontal direction perpendicular to the longitudinal, and a vertical direction perpendicular to the longitudinal direction and the horizontal directions, the housing including— a base configured to provide stability for the dispenser relative to a support surface that is parallel to the longitudinal direction and the horizontal direction; and a top portion positioned above the base along the vertical direction, the top portion and the base defining a gap, the top portion defining a cavity having a stop surface and an aperture extending directly through a lower surface of the top portion directly above the gap, the aperture facing the base;

a receptacle within the cavity in the top portion that is configured to removably receive a reservoir, such that when the reservoir is received by the receptacle, an outlet port of the reservoir is exposed through the aperture; and a pneumatically driven actuator configured to drive a piston in an actuation direction perpendicular to the stop surface such that the piston provides a dispensing force that induces a flow of a predetermined volume of fluid within the reservoir through the exposed outlet port of the reservoir and dispenses the predetermined volume through the aperture, wherein the aperture is positioned between the stop surface and the pneumatically driven actuator along the actuation direction;

wherein the piston is slidable between a start position and an end position along the actuator direction, the actuator direction being within 20 degrees from parallel to the longitudinal direction, the end position being closer to the stop surface than the start position, the stop surface being positioned to engage a second side of the reservoir opposite the first side, the stop surface being within 10 degrees of perpendicular to the actuation direction, the aperture being positioned between the stop surface and the piston along the actuator direction and being closer to the stop surface than the piston along the actuator direction when the piston is in the start position.

2. The dispenser of claim 1, further comprising a pneumatic input port configured to receive a pneumatic hose.

3. The dispenser of claim 1, further comprising:

a sensor that generates a signal when at least an object is positioned proximate to the aperture in the housing or the object is moving relative to the aperture, wherein the signal triggers the actuator.

4. The dispenser of claim 1, further comprising:

a source that emits electromagnetic energy in a frequency band, wherein the frequency band is within the visible spectrum and the emitted electromagnetic energy illuminates at least a portion of the dispenser.

5. The dispenser of claim 1, wherein the actuator includes a driveshaft such that a compressed air source translates the driveshaft, which moves the piston.

6. The dispenser of claim 1, wherein the housing is configured to receive a user's hand intermediate the base and the aperture.

7. The dispenser of claim 6, wherein the base includes a containment depression positioned directly below the aperture and is configured to contain the dispensed volume of fluid.

8. The dispenser of claim 1, wherein the aperture is configured such that when the predetermined volume of fluid flows through the outlet port of the reservoir, the predetermined volume of fluid is dispensed without contacting a perimeter of the aperture.

9. The dispenser of claim 1, wherein the predetermined volume is based on a user selection.

10. The dispenser of claim 1, further comprising:

an inlet port to provide pressurized gas that is at a greater pressure than an ambient pressure, wherein the pressurized gas provides the dispensing force.

11. A dispenser comprising:

a fluid reservoir defining a cylindrical wall and having an outlet extending through the cylindrical wall;

a housing defining a longitudinal direction, a horizontal direction perpendicular to the longitudinal, and a vertical direction perpendicular to the longitudinal direction and the horizontal directions, the housing including a base configured to stably rest on a support surface that is parallel to the longitudinal direction and the horizontal direction; and a top portion positioned above the base and separated therefrom by a gap, the top portion defining a cavity for receiving the fluid reservoir and an opening extending directly through a lower surface of the top portion to the cavity and facing the base, the outlet positioned over the opening;

a pressing member positioned within the fluid reservoir and slidable along the cylindrical wall in an actuation direction, the actuation direction between a start position and an end position, the actuation direction being within 20 degrees of parallel to the longitudinal direction, the opening being positioned between the pressing member and the stop face along the actuation direction and being closer to the stop face than to the pressing member along the actuation direction when the pressing member is in the start position; and an actuator coupled to the pressing member and configured to translate the pressing member along the actuation direction when exposed to a pneumatic source and wherein the actuator urges the pressing member either toward or away from the opening of the cavity.

12. The dispenser of claim 11, wherein the fluid reservoir is positioned within the cavity, the fluid reservoir including a neck extending through the opening.

13. The dispenser of claim 12, wherein no portion of the dispenser other than the base is positioned in a flow path vertically beneath the pressure actuated opening.

14. The dispenser of claim 11, further comprising a pneumatic input port configured to receive a pneumatic hose.

15. The dispenser of claim 11, wherein the actuator includes a driveshaft such that a compressed air source translates the driveshaft to move the piston.

16. The dispenser of claim 11, further comprising:

an inlet port to provide pressurized gas that is at a greater pressure than an ambient pressure, wherein the pressurized gas provides the dispensing force.

* * * * *